US010888164B2

(12) United States Patent
Norman et al.

(10) Patent No.: US 10,888,164 B2
(45) Date of Patent: Jan. 12, 2021

(54) OFFICE SYSTEMS WITH SHAPE MEMORY MATERIALS

(71) Applicant: STEELCASE INC., Grand Rapids, MI (US)

(72) Inventors: Christopher Norman, Byron Center, MI (US); Timothy Swieter, Grand Rapids, MI (US); Ryan E. Schmidt, Rockford, MI (US); Mark McKenna, East Grand Rapids, MI (US); Robert Scheper, Grand Rapids, MI (US); Bruce Smith, East Grand Rapids, MI (US)

(73) Assignee: STEELCASE INC., Grand Rapids, MI (US)

( * ) Notice: Subject to any disclaimer, the term of this patent is extended or adjusted under 35 U.S.C. 154(b) by 0 days.

(21) Appl. No.: 16/581,050

(22) Filed: Sep. 24, 2019

(65) Prior Publication Data

US 2020/0015593 A1 Jan. 16, 2020

Related U.S. Application Data

(63) Continuation of application No. 15/699,545, filed on Sep. 8, 2017, now Pat. No. 10,426,267.

(Continued)

(51) Int. Cl.

*A47C 7/14* (2006.01)
*A47C 7/46* (2006.01)

(Continued)

(52) U.S. Cl.

CPC ..... *A47C 7/14* (2013.01); *A47C 5/04* (2013.01); *A47C 7/285* (2013.01); *A47C 7/32* (2013.01);

(Continued)

(58) Field of Classification Search

CPC .. A47C 7/14; A47C 7/285; A47C 7/32; A47C 7/46; A47C 7/465; A47C 7/72; A47C 5/04

(Continued)

(56) References Cited

U.S. PATENT DOCUMENTS 5,142,757 A 9/1992 Thary
5,871,258 A 2/1999 Battey et al.

(Continued)

FOREIGN PATENT DOCUMENTS

EP 1677014 A1 7/2006

OTHER PUBLICATIONS

"A Revolution in Motion!" MIGA Motor Company, 1 pg, available at https://www.migamotors.com/, dated prior to Sep. 9, 2016.

(Continued)

*Primary Examiner* — Mark R Wendell
(74) *Attorney, Agent, or Firm* — Brinks Gilson & Lione

(57) ABSTRACT

An office system including a first component and a second component moveable relative to the first component. A distance and/or force multiplier is disposed between and coupled to the first and second components. The distance and/or force multiplier includes a shape memory material, wherein the shape memory material is contractible between at least a non-energized state and an energized state in response to an application of energy. The distance and/or force multiplier moves the second component relative to the first component when the shape memory material is contracted to the energized state.

16 Claims, 23 Drawing Sheets

Related U.S. Application Data

(60) Provisional application No. 62/385,646, filed on Sep. 9, 2016, provisional application No. 62/419,095, filed on Nov. 8, 2016.

(51) Int. Cl.
*A47C 7/28* (2006.01)
*A47C 5/04* (2006.01)
*A47C 7/32* (2006.01)
*A47C 7/72* (2006.01)

(52) U.S. Cl.
CPC ..... *A47C 7/46* (2013.01); *A47C 7/465* (2013.01); *A47C 7/72* (2013.01); *A47C 7/723* (2018.08)

(58) Field of Classification Search
USPC ..... 297/284.3
See application file for complete search history.

(56) References Cited

U.S. PATENT DOCUMENTS

| | | | | |
|---|---|---|---|---|
| 6,762,515 | B2 | 7/2004 | Gummin et al. | |
| 6,880,886 | B2 | 4/2005 | Bodnar et al. | |
| 7,097,247 | B2 | 8/2006 | Battey et al. | |
| 7,568,763 | B2 | 8/2009 | Bedford et al. | |
| 8,733,098 | B2 | 5/2014 | Matsuki | |
| 8,800,284 | B2 | 8/2014 | Takahashi | |
| 9,022,476 | B2 | 5/2015 | Battey et al. | |
| 9,186,853 | B2 | 11/2015 | Khan et al. | |
| 9,527,421 | B2 | 12/2016 | Hulway | |
| 2004/0245841 | A1 | 12/2004 | Peterson et al. | |
| 2007/0282228 | A1* | 12/2007 | Einav | A61B 5/16 601/33 |
| 2008/0129098 | A1* | 6/2008 | Kennedy | B60N 2/20 297/354.1 |
| 2009/0043288 | A1* | 2/2009 | Petrakis | G01K 5/483 604/890.1 |
| 2009/0218858 | A1 | 9/2009 | Lawall et al. | |
| 2009/0224584 | A1 | 9/2009 | Lawall et al. | |
| 2009/0224587 | A1 | 9/2009 | Lawall et al. | |
| 2010/0033002 | A1 | 2/2010 | Di Giusto et al. | |
| 2011/0048482 | A1* | 3/2011 | Yerian | E06B 9/24 135/125 |
| 2012/0192299 | A1 | 8/2012 | Khan et al. | |
| 2012/0267928 | A1 | 10/2012 | Mankame et al. | |
| 2015/0301559 | A1* | 10/2015 | Wu | F16M 11/041 248/229.16 |
| 2016/0068938 | A1 | 3/2016 | Khan et al. | |
| 2017/0165532 | A1 | 6/2017 | Khan et al. | |

OTHER PUBLICATIONS

"Shape-Memory Alloy" dated Aug. 31, 2016, 7 pgs, Wikipedia, available at https://en.wikipedia.org/wiki/Shape-memory_alloy.

* cited by examiner

OFFICE SYSTEMS WITH SHAPE MEMORY MATERIALS

This application is a continuation of U.S. application Ser. No. 15/699,545, filed Sep. 8, 2017 and entitled "Office Applications With Shape Memory Materials," which application claims the benefit of U.S. Provisional Application No. 62/385,646, filed Sep. 9, 2016 and entitled "Adjustable Seating Structure With Shape Memory Materials," and U.S. Provisional Application No. 62/419,095, filed Nov. 8, 2016 and entitled "Office Applications With Shape Memory Materials," the entire disclosures of which are hereby incorporated herein by reference.

FIELD OF THE INVENTION

The present application relates generally to office systems and applications configured with, or using, shape memory materials, including for example an adjustable seating structure, and in particular a seating structure using shape memory materials to adjust and/or control the shape, contour and/or flexibility of the seating structure, for example a seat or backrest of a chair or other body supporting member.

BACKGROUND

Body supporting structures, including for example office chairs, vehicular and aircraft seating, sofas, beds and other pieces of furniture, may be configured with a backrest or seat that is flexible, and may change shape in response to a load applied by a user. In some embodiments, the amount of flexibility of the seat and/or back is predetermined, and may not be adjusted by the user. As such, the user may lack the ability to tune the stiffness/flexibility of the body supporting structure.

In other embodiments, the shape of the body support structure may be altered, for example by adjusting a lumbar support. Typically, such adjustments are not dynamic, but rather depend on a user input, for example to apply more or less tension to a lumbar support. In this way, the adjustments are made reactively, rather than proactively. In addition, the mechanisms for making such adjustments are often bulky, and may interfere with the aesthetics of the seating structure, for example when disposed across an open backrest. Moreover, the mechanisms may include various moving parts that are subject to failure and require replacement and maintenance over time.

In some embodiments, for example automotive or aircraft seating, powered adjustment mechanisms may require relatively large amounts of energy. Conversely, seating structures that are not tethered to a power source, such as office chairs, require a manual input for the adjustment mechanism, which often requires a bulky user interface.

SUMMARY

The present invention is defined by the following claims, and nothing in this section should be considered to be a limitation on those claims.

In one aspect, one embodiment of a seating structure includes a body support assembly having laterally spaced opposite sides and at least one laterally extending flexible body support member. The body support member is flexible between a nominal configuration and a flexed configuration in response to a load being applied by a user. The flexible body support member includes a shape memory material extending along at least a portion of a length of the flexible body support member. The shape memory material is contractable between at least a non-energized state and an energized state in response to an application of energy. The shape memory material biases the flexible body support member toward the nominal configuration when the shape memory material is contracted to the energized state.

In another aspect, one embodiment of a method of supporting a user in a seating structure includes supporting a user with a body support assembly having laterally spaced opposite sides and at least one laterally extending flexible body support member, flexing the body support member between a nominal configuration and a flexed configuration, applying energy to a shape memory material, contracting the shape memory material, and biasing the body support member with the shape memory material toward the nominal configuration.

In another aspect, one embodiment of a seating structure includes a body support member having laterally spaced opposite sides and longitudinally spaced ends. The body support member has a curvature in least one of the lateral and longitudinal directions, wherein the curvature is changeable between at least first and second configurations. The body support member includes a shape memory material extending in at least one of the lateral and longitudinal directions, wherein the shape memory material is attached to the body support member at two spaced apart locations. The shape memory material is contractable between at least a non-energized state and an energized state in response to an application of energy. The shape memory material biases the flexible body support member between the first and second configurations when the shape memory material is contracted to the energized state.

In yet another aspect, a method of supporting a user in a seating structure includes supporting a user with a body support assembly having laterally spaced opposite sides and longitudinally spaced ends, wherein the body support member has a curvature in at least one of the lateral and longitudinal directions, applying energy to a shape memory material, contracting the shape memory material, and altering the curvature of the body support member with the shape memory material.

In yet another aspect, one embodiment of an office system includes a first component and a second component moveable relative to the first component. A distance and/or force multiplier is disposed between and coupled to the first and second components. The distance and/or force multiplier includes a shape memory material, which is contractible between at least a non-energized state and an energized state in response to an application of energy. The distance and/or force multiplier moves the second component relative to the first component a when the shape memory material is contracted to the energized state.

The various embodiments of seating structures and methods provide significant advantages over other seating structures and methods. For example and without limitation, the stiffness/flexibility of the seating structure may be adjusted quickly and easily by activating the shape memory material. The shape memory material requires much less energy or power than conventional motors and actuation mechanisms. Moreover, the shape memory material is extremely robust and has a long life, which minimizes the need for replacement and maintenance. In addition, the shape memory materials may be programmed to provide proactive dynamic movement, for example a massage effect. Also, the seating structure may be easily packaged in a compact fashion.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
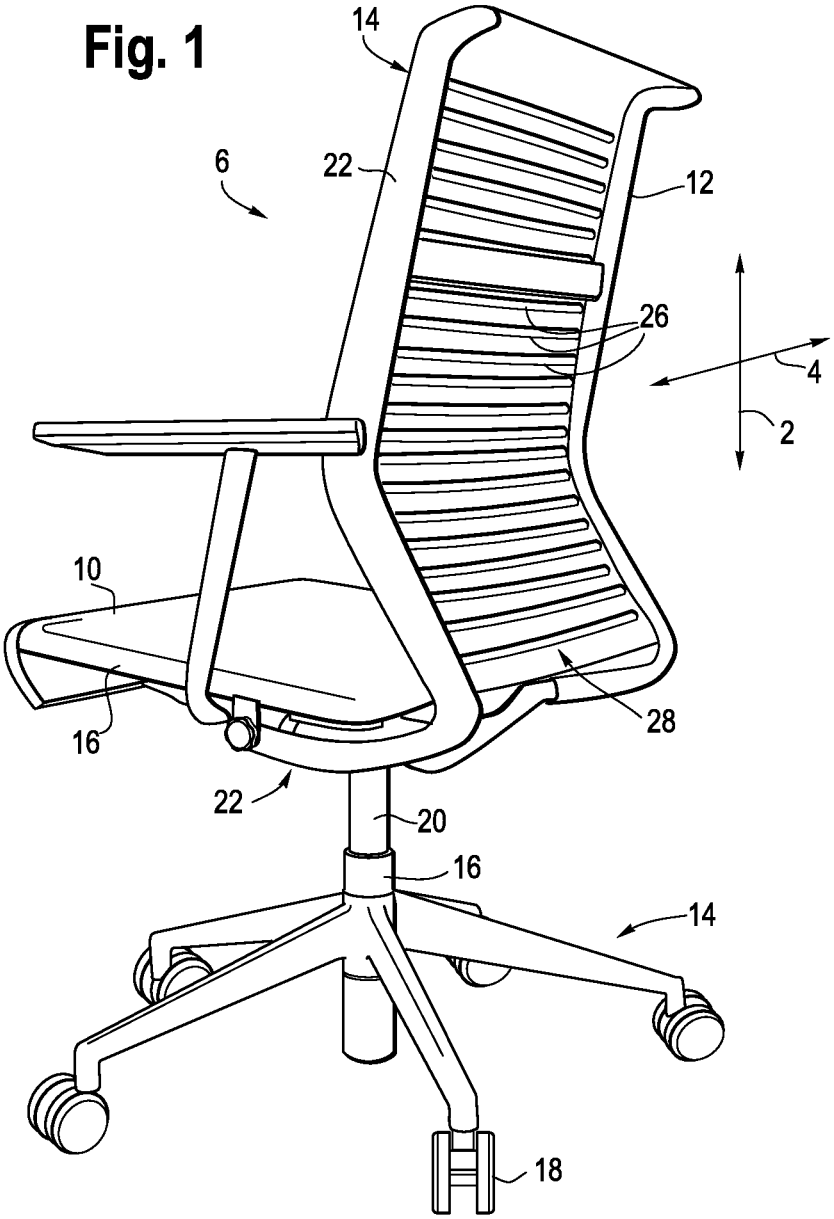
FIG. 1 is a perspective view of one embodiment of an office chair incorporating a shape memory material.
Figure 2:
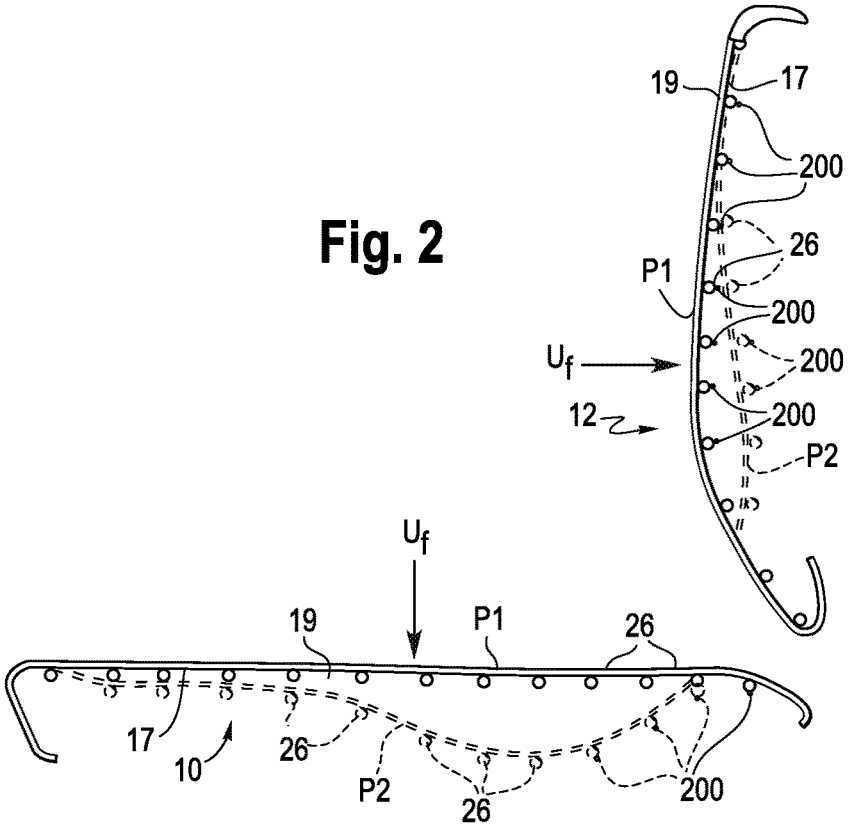
FIG. 2 is a schematic side view of the office chair shown in FIG. 1 with the seat and backrest in first and second shape configurations.
Figure 4A:
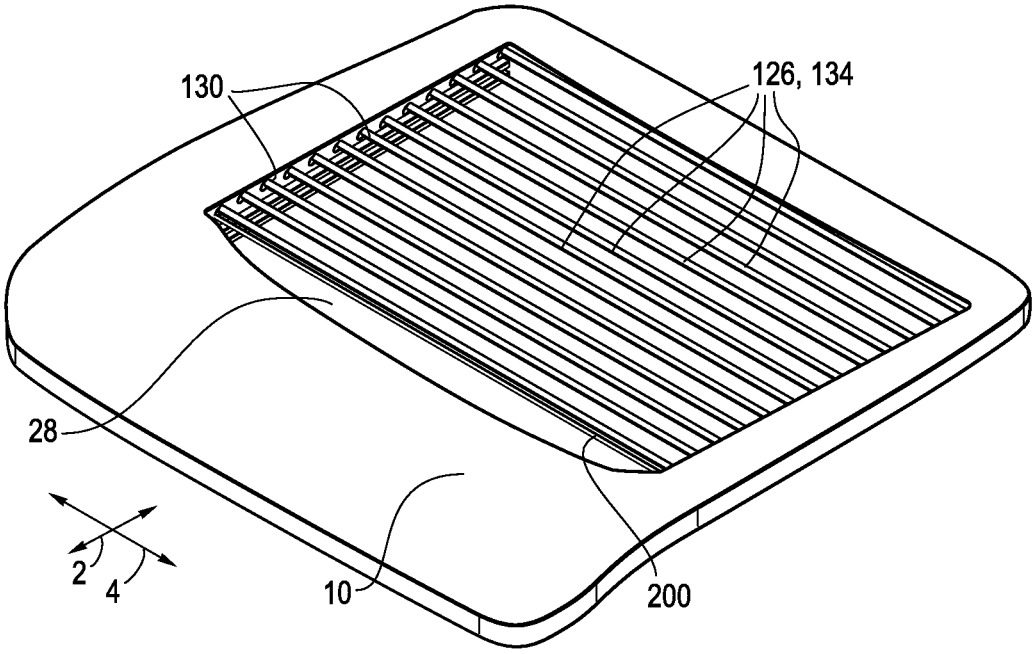
FIG. 4A is top perspective view of another embodiment of a body support assembly.

It should be understood that the term "plurality," as used herein, means two or more. Referring to FIGS. 1 and 4A for example, the term "longitudinal," as used herein means of or relating to a length or lengthwise direction 2, for example a direction running from a top to bottom of a backrest, or a front to back of a seat, and vice versa (bottom to top and back to front). The term "lateral," as used herein, means situated on, directed toward or running in a side-to-side direction 4 of the backrest or seat. The term "coupled" means connected to or engaged with whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. Also, any reference to first and second, for example in referring to configurations, does not mean that the feature or item so designated does not also have other configurations, but that the feature or item has at least first and second configurations, which may be variable. The terms "upper," "lower," "rear," "front," "fore," "aft," "vertical," "horizontal," and variations or derivatives thereof, refer to the orientations of the exemplary seating structure as shown in FIGS. 1 and 2. The phrase "seating structure" refers to a body supporting structure, including without limitation office furniture, home furniture, outdoor furniture and vehicular seating, including automotive, airline, marine and passenger train seating, and may include without limitation beds, chairs, sofas, stools, and other pieces of furniture or types of body supporting structures.

Seating Structure

Referring to the drawings, FIGS. 1 and 2 show one embodiment of a seating structure configured as an office chair 6 having a base 8, a seat 10 and a backrest 12. The base includes a leg assembly having a plurality of support legs 14 (shown as five) extending from a central hub 16. A distal end of each support leg includes a floor engaging member 48, shown as a caster in one embodiment. Other floor engaging members may include for example and without limitation a glide, foot or pad. A support column 20 is supported by and extends upwardly from the central hub 16. The support column 20 may have a fixed height, or may be height adjustable, for example being configured with a telescopic column having a pneumatic or hydraulic actuation mechanism. A control housing 22, for example a tilt control housing, is supported by an upper end of the support column 20. It should be understood that the phrase "control housing" refers to a housing structure, as well as any tilt mechanism disposed therein. The control housing may include a tilt mechanism that controls the movement of one or both of the seat and backrest in a fore and aft and/or up and down direction.

Body Support Assembly

Figure 3:
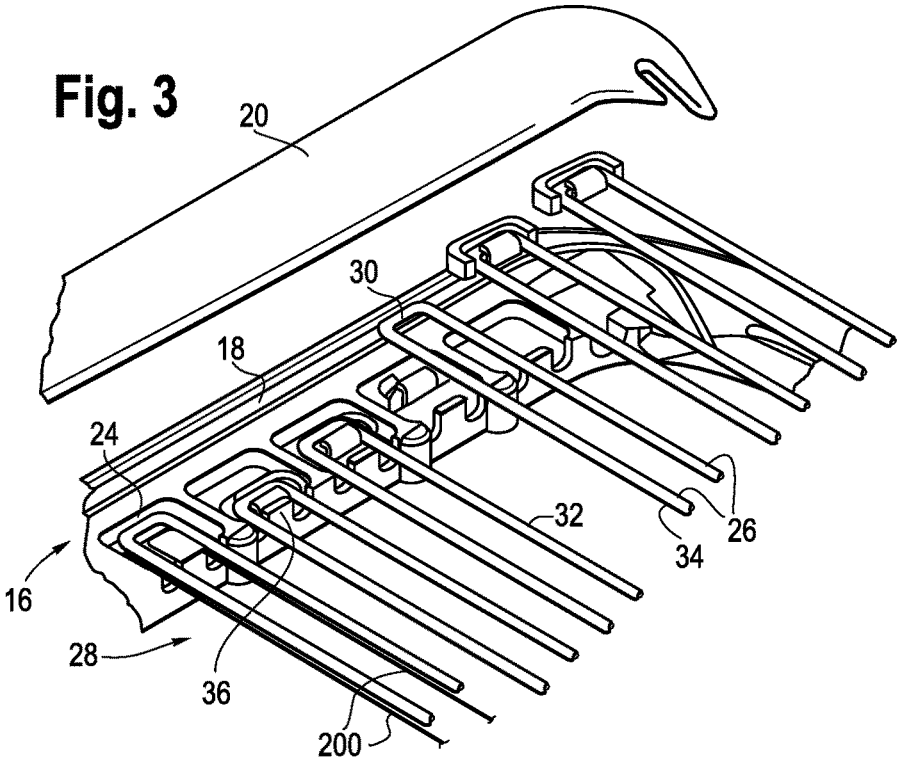
FIG. 3 is a partial view of one embodiment of a body support assembly.
Figure 11A:
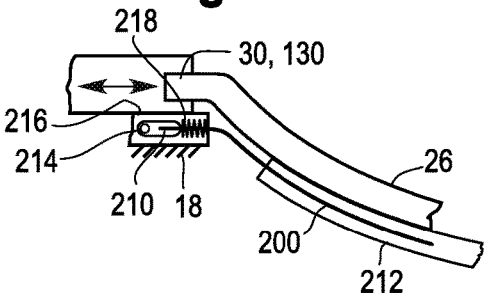
FIGS. 11A, B and C are enlarged partial views of the body support assembly shown in FIG. 10, with the support element in a nominal, non-energized state, a flexed, non-energized state, and a nominal, energized state respectively.
Figure 11B:
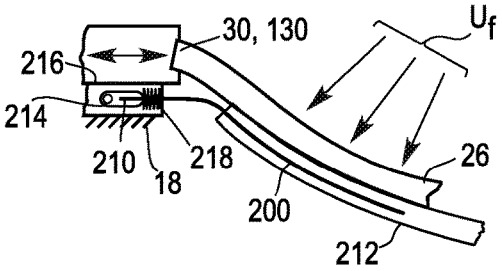

In one embodiment, shown in FIG. 3, the seat 10 and backrest 12 each have a frame 14, which includes a pair of laterally spaced apart side sections 18, 22, each defining a plurality of pockets 24. A plurality of flexible, laterally extending body support members 26 extend laterally across an open space 28 between the side members. It should be understood that, in other embodiments, body support members may extend longitudinally, for example between longitudinally spaced first and second ends of a frame, formed for example by a shell. The ends 30 of the body support members are slideably supported in the pockets 24, allowing for lateral movement of the ends as the body support members 26 flex or bend between the ends thereof, as shown in FIG. 2. A cover 20 may be secured over the side sections 18, slideably enclosing the ends 30 in the pockets 24. When a load is applied by the body of the user $U_F$, the body support members are flexed between a nominal (P1), unloaded configuration, and a flexed configuration (P2), loaded configuration. In particular, as shown in FIGS. 2 and 11A and B, the body support members 26 bend rearwardly (backrest) or downwardly (seat), with the ends 30 thereof sliding inwardly within the pockets until they reach the stop.

Figure 4B:
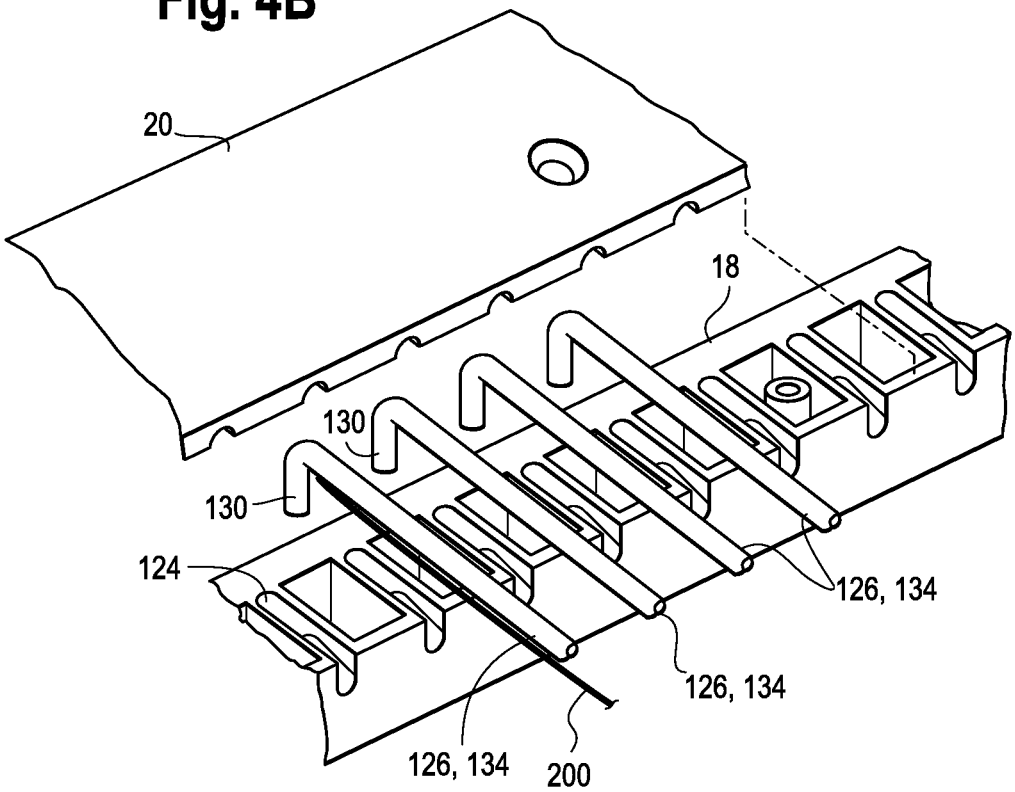
FIG. 4B is an exploded partial view of the body support assembly shown in FIG. 4A.

In this embodiment, the plurality of body support members 26 each define support elements, with the body support members and support elements being independently flexible relative to each other. The body support members may be configured as a rectangular shape loop 32 having a pair of support elements 34, with the loop end 30 surrounding a stop 36 formed on the side section 18. Alternatively, as shown in FIG. 4B, the body support members 126 are each configured as a single support element 134 having a downturned end portion 130 received in pocket 124, In either case, the travel of the end portions 30, 130 are limited by the stop, formed at an inner portion of the pockets. The body support members may be made of metal, for example hard drawn spring steel, although they may be made of other materials, including various plastics and composites. The body support members may be wire, with various circular, elliptical, or polygonal cross sections, or may be made as a strap, having a greater width than thickness for example. In various embodiments, the body support members have spring-like characteristics or are supported by a separate member spring-like element, for example at an end portion thereof. For example, the back support member may be made of spring wire, or the back support member may be configured as a slat made of plastic, but with and end or edge thereof being used to help govern how much difference in deflection may occur between two adjacent slats, with an auxiliary spring loaded lumbar providing a liveliness to the entire back system. Additional features of the seat and back are disclosed in U.S. Pat. No. 6,880,886, the entire disclosure of which is hereby incorporated herein by reference.

Figure 8:
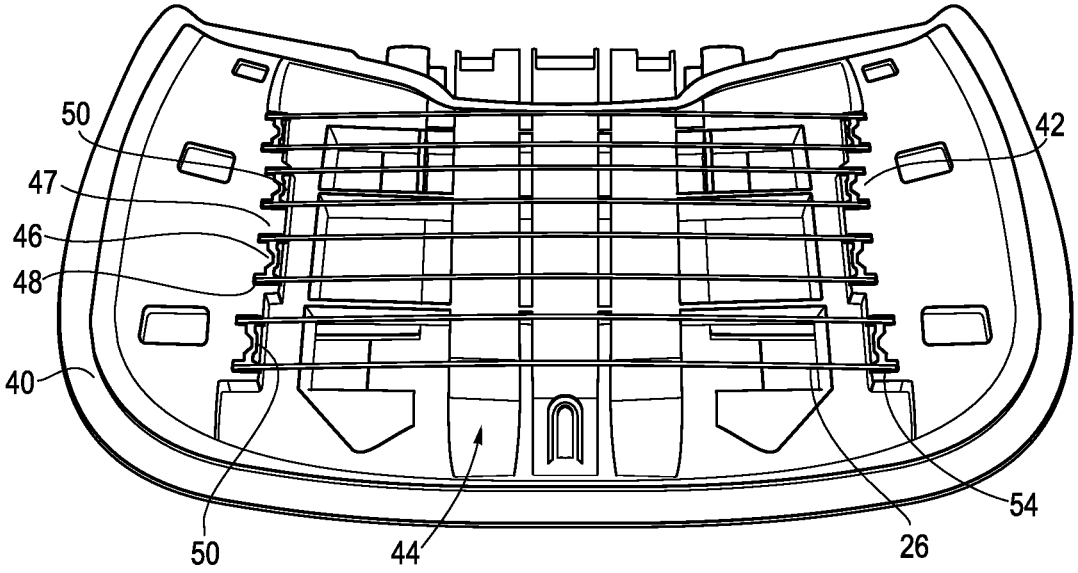
FIG. 8 is a front view of another embodiment of a body support assembly with body support member in a nominal configuration.
Figure 9:
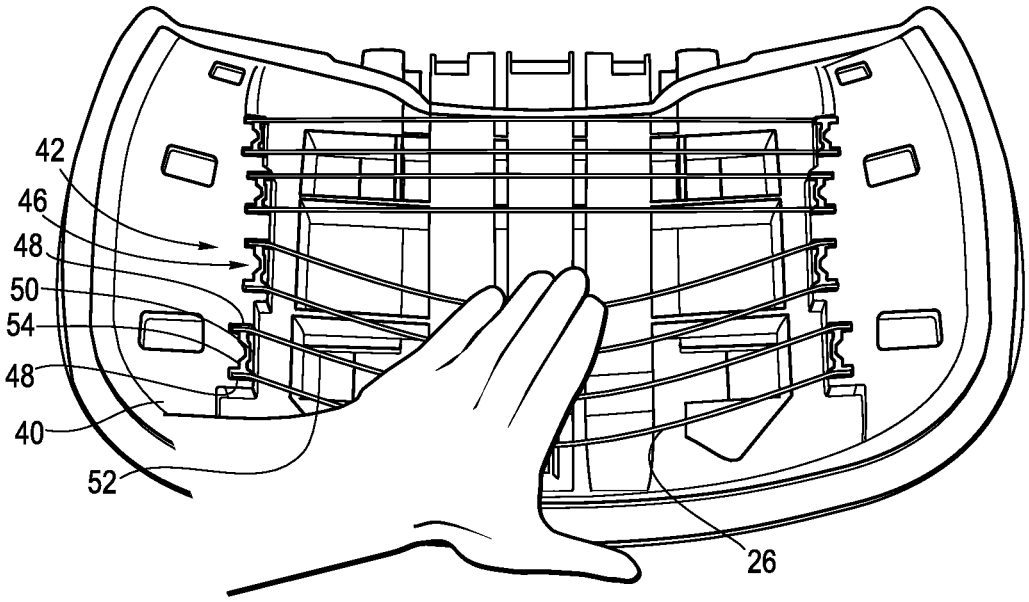
FIG. 9 is a front view of the body support assembly shown in FIG. 8 with some of the support elements in a flexed configuration.

Referring to the embodiment of FIGS. 8 and 9, a body support assembly includes a rigid shell 40, or frame, having protruding side sections 42 laterally spaced apart and defining an opening 44 there between above a bottom surface of the shell 40, The side sections 42 have openings 46 defining tracks 48. The openings have an H-shaped mouth, with an open cross portion allowing insertion of an end of a body support member through the opening, and opposite tracks 48 for guiding the body support members 26. The middle portion between the tracks defines a stop 50. A plurality of body support members, shown as rectangular loops 52 with square loop end portions 54 are disposed in the tracks. The body support members may independently flex or bend, as shown in FIG. 9, from a nominal configuration to a flexed configuration, with the end portions 54 of the body support members moving/sliding within the track 48 until they engage the stop member 50 at the inner end of the tracks. As shown in FIG. 8, the assembly may be incorporated into a seating structure as a lumbar support, or maybe extended to the entirety of a backrest or seat.

Figure 5A:
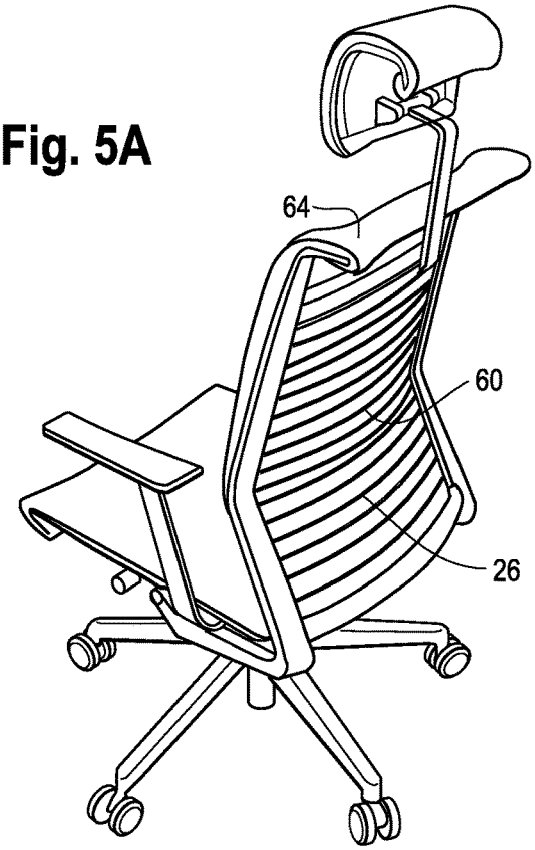
FIG. 5A is rear perspective view of another embodiment of a body support assembly.
Figure 5B:
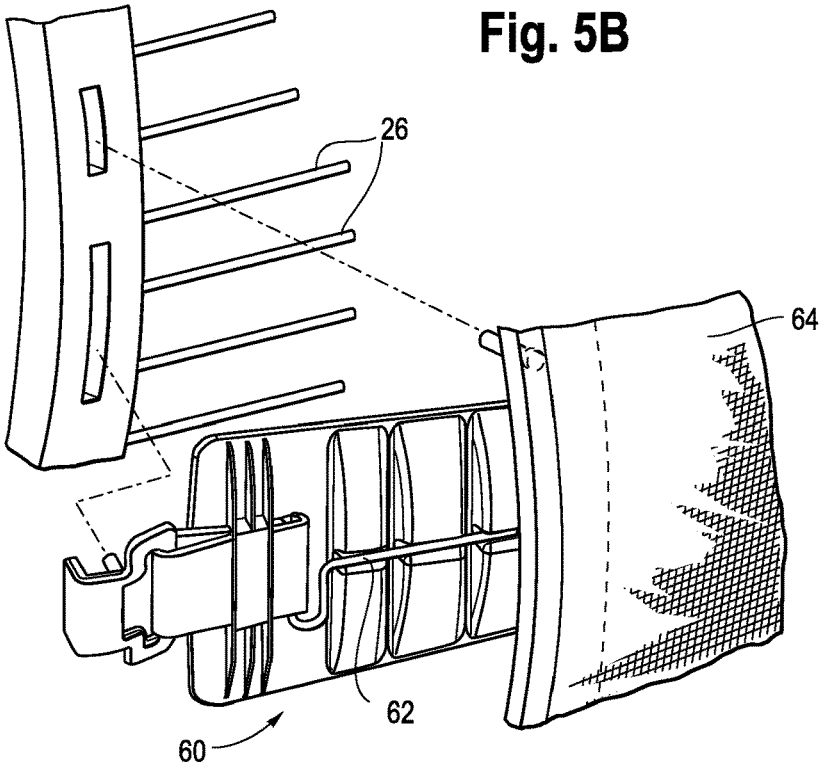
FIG. 5B is an exploded partial view of the body support assembly shown in FIG. 5A.

As shown in FIGS. 5A and B, an auxiliary body support member 60 may engage a front or rear surface of a primary body support member, for example between body support members 26 and a cover member 64. The auxiliary body support member may be located in a lumbar region of a backrest for example. The auxiliary body support member includes a support element 62, for example a wire, which extends laterally across the body support element and is coupled to a pair of handles that are secured to the side sections of the frame. The body support member, or support element, may also be configured as a rectangular loop configuration.

Figure 6:
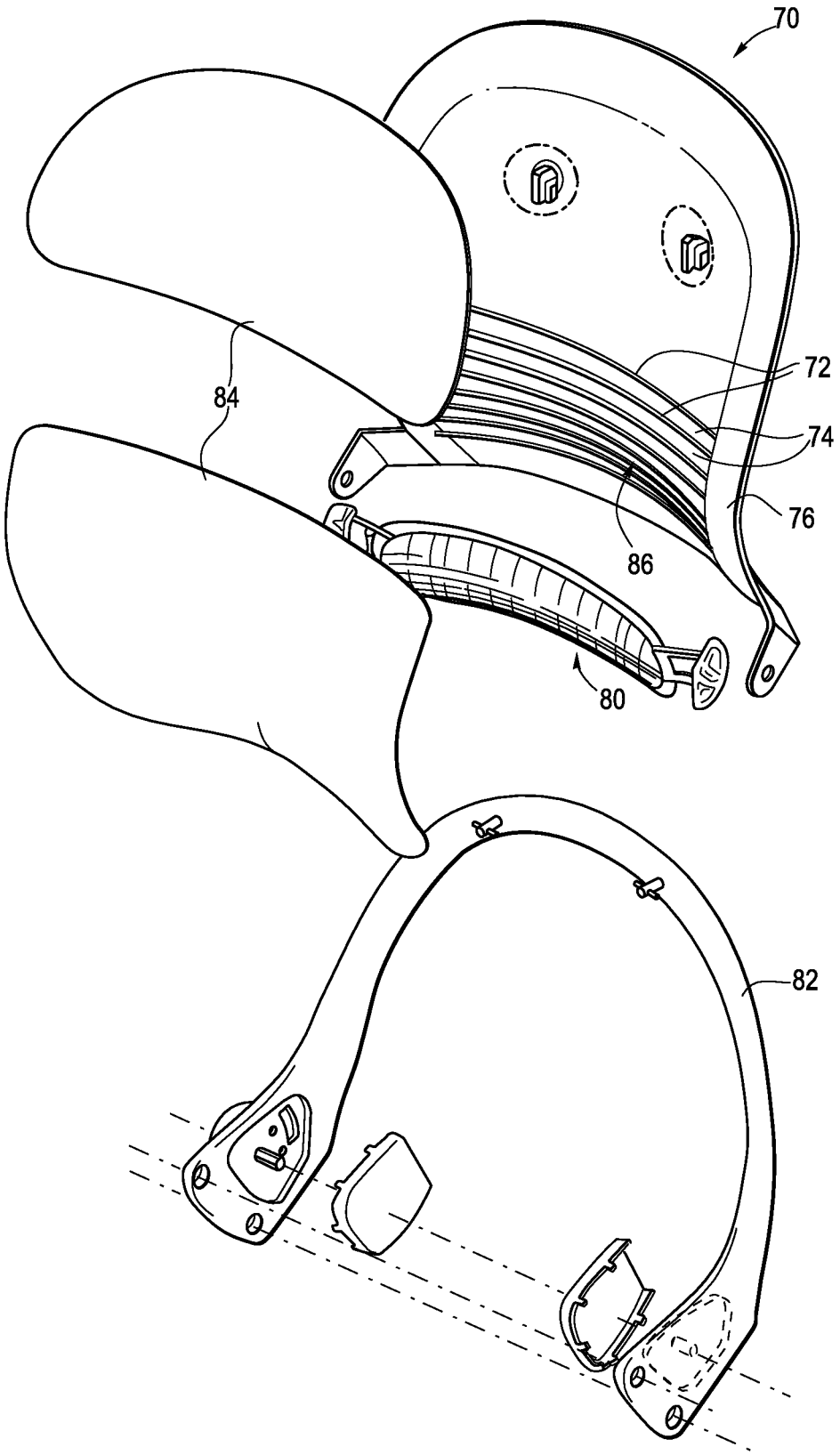
FIG. 6 is front perspective view of another embodiment of a body support assembly.
Figure 7:
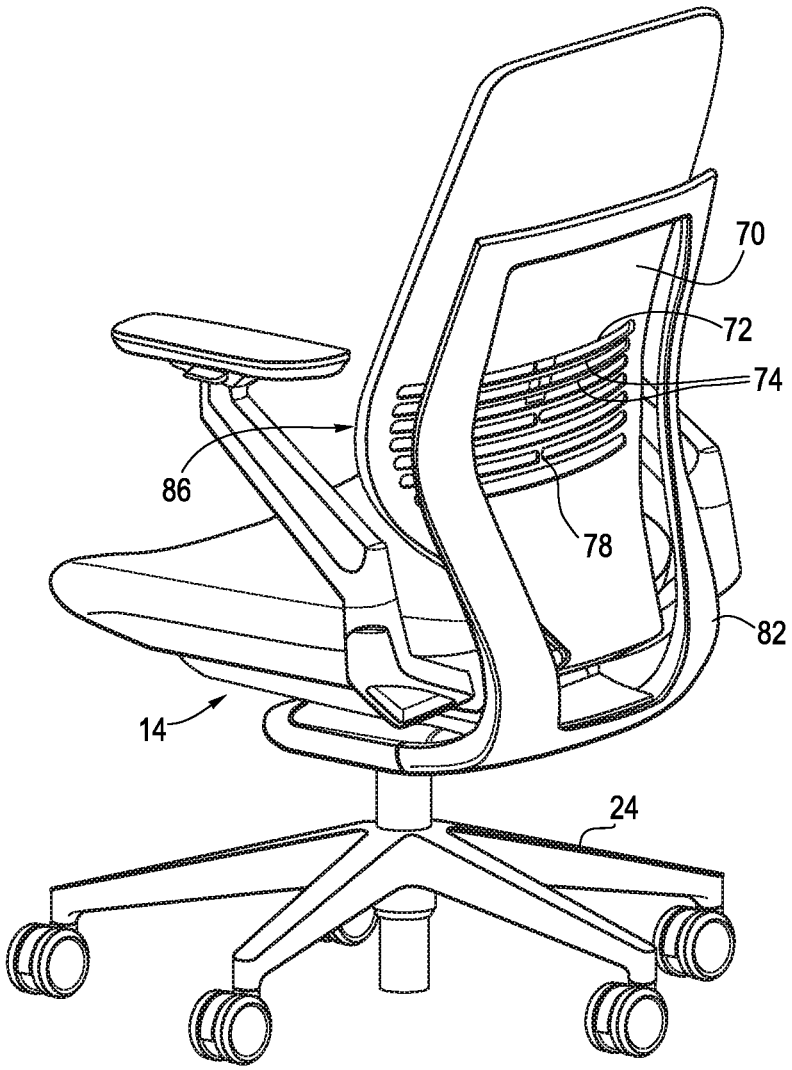
FIG. 7 is rear perspective view of another embodiment of a body support assembly.

Referring to FIGS. 6, 7, 12 and 13, a body support member, configured as a shell 70, includes opposite, longitudinally extending side portions 76 and a plurality of laterally extending and longitudinally spaced slots 72 or openings that define a plurality of straps, or support elements 74. In the embodiment of FIG. 7, a longitudinal connector 78 may extend between and connect adjacent straps, for example along a center axis, although it should be understood that a plurality of connectors may be provided and located along the length of the straps. The slots 72 allow for the straps 74 to move independently. The body support member has a curvature in the longitudinal direction, for example an outwardly, or forwardly facing bowed portion 86 in the lumbar region of the backrest. An auxiliary lumbar support 80 may be provided across the front or rear of the body support member 70. A frame 82 supports the shell, and one or more covers 84 maybe coupled to a front of the shell. The body support member may also have curvature in the lateral direction, for example forming a forwardly facing concave shape as also shown in FIG. 6. The side sections 76 of the shell may be made flexible, such that the curvature of the bowed portion 86 may be changed, for example such that the curvature is decreased from a nominal configuration (FIG. 14A) to a flexed configuration (FIG. 14B) in response to a load being applied thereto by a user. In other embodiments, the curvature may be increased in response to a load being applied to the body support member.

Figure 34:
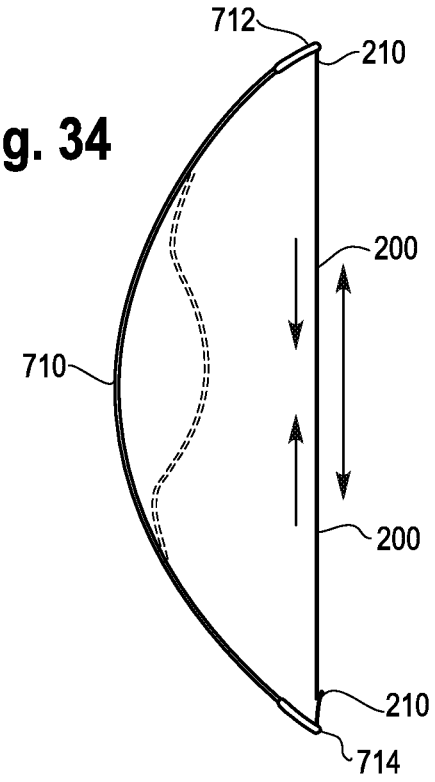
FIG. 34 is a schematic of a screen incorporating a shape memory material.

Referring to FIG. 34, a screen 710 may be similarly configured as a bowed member having spaced apart end portions 712, 714.

Figure 16:
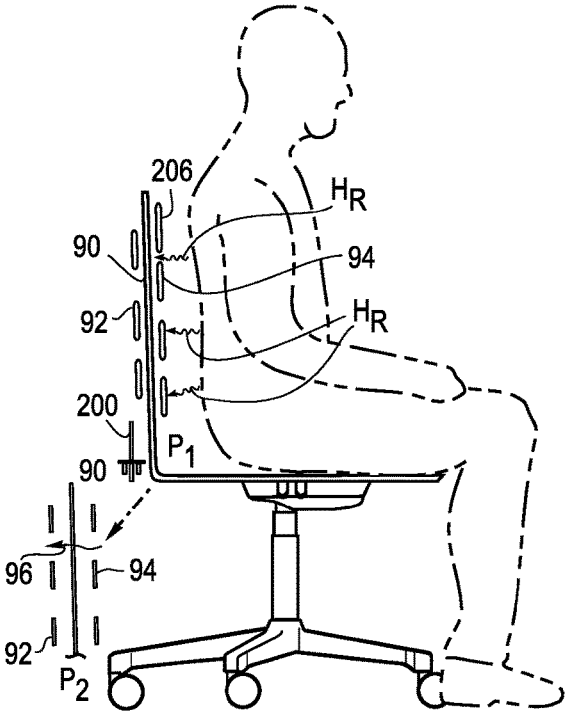
FIG. 16 is a side view of another embodiment of a body support assembly.

Referring to FIG. 16, a body support member 90 is provided with a moveable vent member 92, 94, for example on a back. The vent member, or a pair thereof, may be moved between a first, closed position $P_1$, to a second, open position P2, with an air passageway 96 between a front and a back of the body support member being created when the vent member(s) are moved to the open position. It should be understood that some air flow may be generated in the closed position but that a greater air flow is allowed in the open position.

Shape Memory Materials

Referring to FIGS. 2, 3, 4B, 10-11B and 34, a shape memory material 200 is coupled to the body support member, and in particular the support element, or the spaced apart portions 712, 714 of the bowed screen 710. Although the shape memory material 200 is shown as only being coupled to one or more of the body support members in the drawings for the sake of illustration, it should be understood that that the shape memory material may be coupled to all of the body support members, and corresponding support elements. The relative size and/or dimensions of the shape memory materials may not be to scale in the drawings for the sake of illustration. It should be understood that the shape memory material may be integrally formed as part of the body support member, for example by co-extrusion or co-molding.

Shape memory materials (SMM) are materials that may be bent or stretched, or otherwise deformed, to a new shape or length, with the shape memory material holding that shape until they are elevated to a transition or transformation temperature, wherein after the material reverts to its original shape, for example by straightening, contracting or shortening. For example, a SMM may shorten 4%. Typically, the material is elevated to the transition/transformation temperature by applying energy, for example an electrical current, which results in Joule heating. Radiant energy may also be applied to activate the SMM.

The shape memory effect is realized, for example, by the material changing from a martensite state (deformable) to austenite state. Shape memory materials (SMM) include shape memory alloys (SMA), including for example nickel-titanium (NiTi) or nitinol, copper-aluminum-nickel and copper-zinc-aluminum-nickel, and shape memory polymers (SMP), including for example polyurethane-based shape-memory polymer with ionic or mesogenic components and polyethylene-terephthalate-polyethyleneoxide (PET-PEO) block copolymer crosslinked using Maleic Anhydride. Other SMMs, not listed herein, may also be suitable. Typically, the SMA is coated or sheathed, for example with silicon, to isolate the SMA from the other components and/or user. The SMA may have a one-way memory or a two-way memory. With two-way memory, the material has a shape-memory effect upon both cooling and heating. SMA activation is typically asymmetric, with a relatively fast actuation time and a slow deactivation time. The SMA deactivation time may be reduced through forced convection and lagging the SMA with a conductive material in order to manipulate the heat transfer rate and make a more symmetric activation profile.

Figure 10:
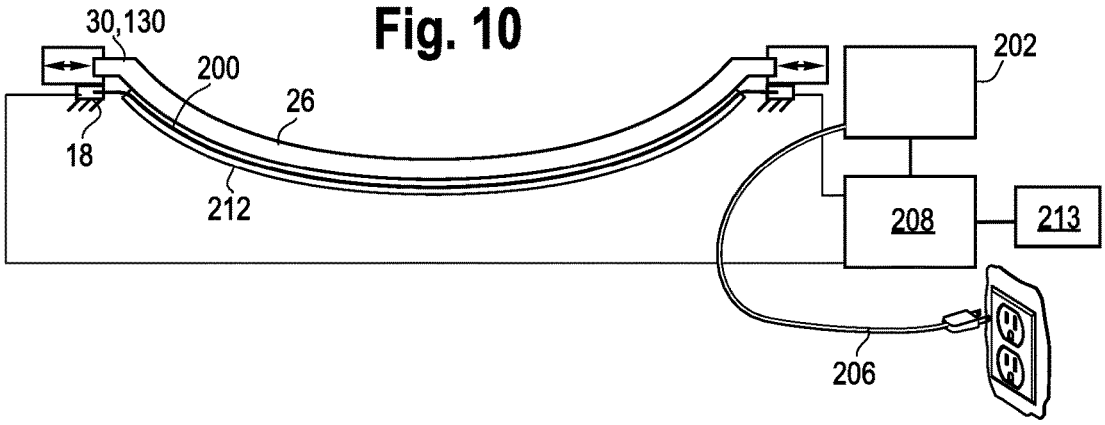
FIG. 10 is a cross sectional view of the body support assembly shown in FIG. 9.

Referring to FIG. 10, a power source 202, for example a battery, may be coupled to the seating structure. Alternatively, the power source may be provided by an outlet 204, connected for example with a cord 206, or a generator other energy supply system, including a wireless power source. A controller 208, also coupled to the seating structure in one embodiment, controls the amount of current supplied to each SMA coupled to a corresponding body support member. For example, the controller 208 may be programmed to supply current to a plurality of SMA(s) 200 coupled to corresponding body support members 26 collectively, or at the same time, or sequentially, for example to adjacent body support members (each including 2 sets of support elements) progressing from top to bottom, and/or vice versa, so as to provide a rolling massage effect. It should be understood that the controller 208 and power source 202, 204, 206 may be coupled to any of the SMA embodiments disclosed herein, whether being incorporated into a seating structure or other office or household component or accessory. Since the each SMA may be individually and independently activated, or energized, the body support assembly may be tuned to suit the needs of any particular individual. The controller may also control the supply of power or energy to a selected subgroup of SMA(s) and corresponding body support members, for example every other body support member, in response to specific load requirements, or if the amount of available power is limited. In this case, adjacent body support members 26 may be coupled, for example two body support members maybe coupled or bridged with a force multiplier, such as a plastic sheet or other tether, allowing for the body support members to be moved together. Indeed, a lesser number of SMAs may be used to control or bias a greater number of body support members in this fashion.

Figure 17:
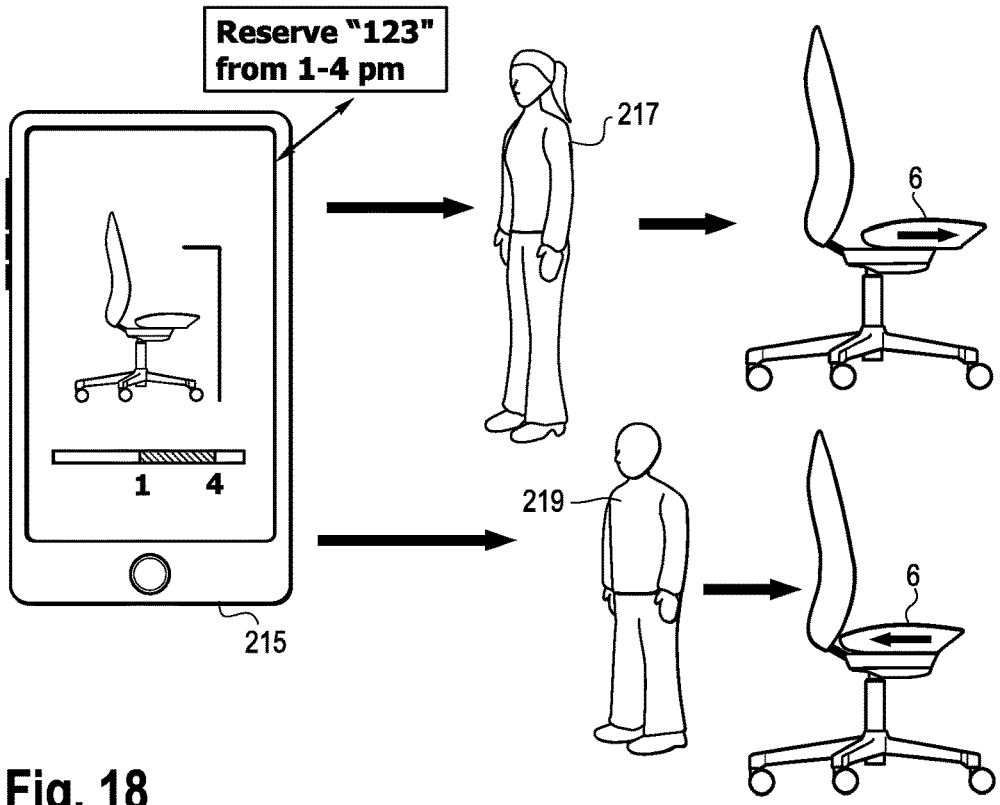
FIG. 17 is a schematic view showing wireless control of a seating structure.
Figure 27:
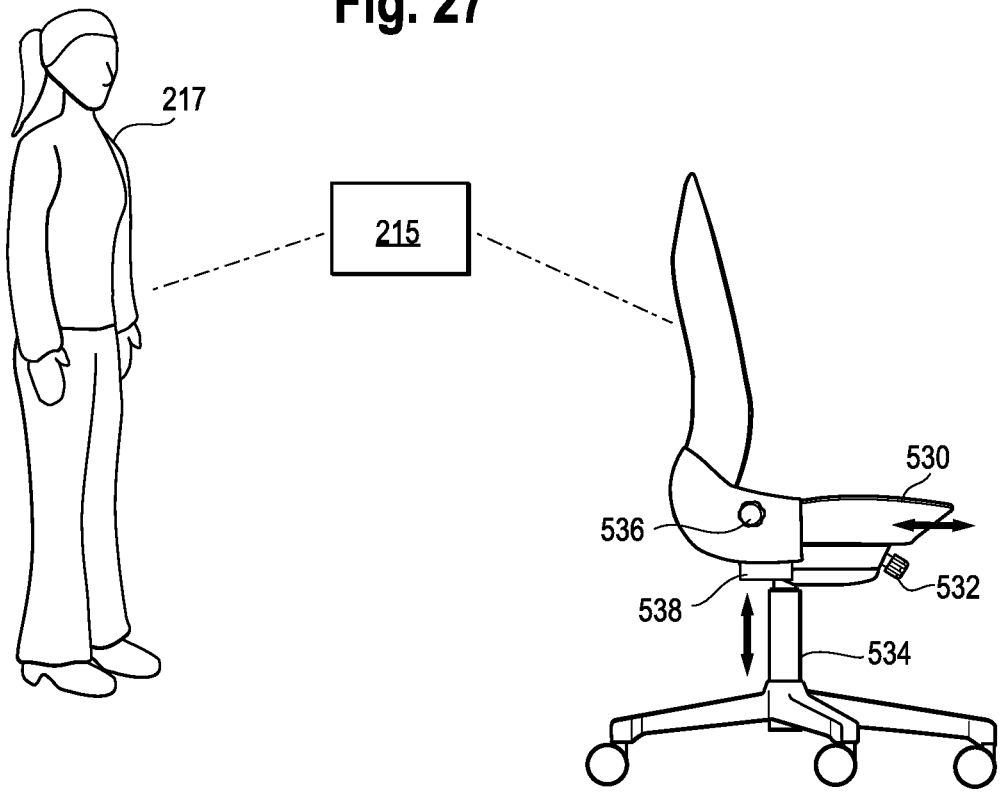
FIG. 27 is a side view of a seating structure incorporating various shape memory material actuators.

Control of the system may incorporate three different features or components, including control electronics that distribute current to the SMA, a sensing mechanism, which may include a SMA or other sensors 213 (see FIG. 10) embedded within the assembly such as occupancy sensors (accelerometers or strain gauges), posture sensors, heart rate sensors or body temperature sensors. The third feature/component, included in the controller 208, is the circuitry, software and algorithms that receive various inputs from the sensor and provide outputs to the control electronics. The seating structure may be "standard" or "dumb" in that there is a simple control panel with a user interface that may be actuated the user to turn the system on/off. Conversely, the seating structure, or other assembly, may be "smart" in that it is connected to a user interface, such as wirelessly to a mobile device. The controller and user interface may include additional features, providing for example a massage mode, or adjusting the relative stiffness of the seating structure. The controller may also include seamless service, such as blue tooth or a mobile device that identifies the user and adjusts or actuates the chair based on the user preferences identified by the controller without any active actuation by the user. In this embodiment, shown for example in FIGS. 17 and 27, an outside or remote system 215 (mobile device, another piece of furniture or a connection to the cloud) identifies the user 217, 219 and automatically adjusts the chair 6 according to the user preferences. A system may also remotely retrieve data from various calendars, thereby pre-setting a seating structure, or other office component, before the arrival of the user depending on the designated schedule. This may be adopted, for example, to adjust seat depth via a seat depth adjustment mechanism 530, tilt or back tension via a tilt adjust mechanism 532, height adjustment via a support column 534 and seat/back flexibility, (e.g., lumbar tension mechanism 536), with all of the components 530, 532, 534, 536 incorporating or being configured with an SMA as described herein. The components, or SMAs associated therewith, may be powered by a small battery 538, or other power source, which may be recharged wirelessly/RF/solar/piezo-electric, or by way of other kinetic energy harvesters.

The SMA 200 may also function as a sensor, for example by registering a change in resistance, which in turn provides information to the controller 208. For example, the SMA may provide strain information, showing a deflection of the corresponding body support member, to the controller. The strain information may be used to customize the force/shape that the SMA creates in support of each individual user's back. For example, the controller in turn, may then activate one or more SMAs to act on the body support member(s).

The SMA may also be configured to contract different amounts depending on the amount of energy supplied. In other words, the SMA may have different portions or segments with different transition/transformation temperatures, such that the controller 208 may supply different levels of energy to the SMA, such that it provides different levels of contraction and corresponding biasing forces to the body support member 26. In this way, for example, the controller may be programmed to provide a softer support surface for a lighter person. The controller may also include a user interface, wherein the user may set the relative stiffness of the SMA, by way of the level of supplied energy, and correspondingly the relative stiffness of the body support member. The controller may also provide for micro-movement of the body support members, which may be utilized to move patients to prevent bed sores, or improve blood flow.

In some embodiments, the seating structures may be "tuned" before they are shipped to the user, such that one seating structure is configured with SMA(s) appropriate to provide a restoring force suitable for a lighter person, e.g., 100 pounds, versus another seating structure configured with SMA(s) appropriate to provide a restoring force suitable for a heavier person, e.g., 200 pounds. Of course, other options below, above and between those examples are envisioned. The restoring forces may be correlated with different size chairs, for example a lesser restoring force for a smaller chair, and vice versa for a larger chair. Alternatively, a sensor (SMA or other) may provide data about how big (heavy/tall/etc.) the user is, and provide a correlated restoring force, whether by controlling selected ones of individual body support members, or by altering the restoring force of each body support member. As mentioned, the controller may be programmed such that one, two, etc., or all SMAs are actuated, and in what order or sequence. The SMA may also be duel stage, with the controller capable of adjusting or actuating both stages.

In various embodiments, a lesser current, or smaller amount of electricity may be run through the SMA, such that the SMA contracts less. In this way, the SMA(s), collectively and individually, may be tuned with the controller. For example, the speed of the contraction may be altered, as can the amount of total contraction, by applying less current (speed) and/or by stopping the current altogether before complete contraction is realized.

Referring to FIGS. 10-11C and 34, the SMA 200 has opposite ends 210 fixedly connected to a frame, for example side sections 18 thereof. The SMA is attached to a non-body facing side 17, opposite the body facing side 19 (see FIG. 2), of the body support member. In one embodiment, a conduit 212, e.g., tube, is secured along a length of the body support member, with the SMA moveably disposed in the conduit. The ends of the SMA may be configured with a ferrule 214, which is disposed in a connector housing 216. A compression spring 218 acts between the housing 216 (or other stop) and ferrule 214. The power source 202 is electrically connected to the end 210 of the SMA, such that energy, e.g. current, may be supplied to heat the SMA 200. The springs 218 dynamically/automatically adjust to the user's unique shape, for example the shape of the user's lumbar. In addition, the springs 218 provide a force against the user's lumbar which helps maintain the user's lumbar and pelvis in a healthy orientation and posture. In addition, these springs 218 provide a lively, dynamic response that allows the lumbar shape to change and continue to support the user during postural changes. In this way the body support members continue to provide dynamic support even if the SMA is not activated.

Operation

Figure 11C:
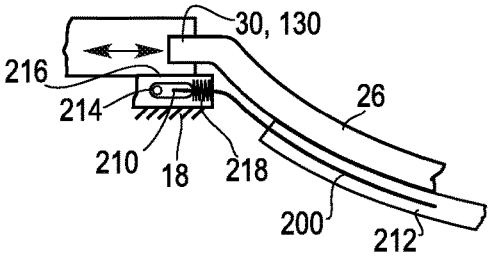

In operation, a user $U_F$ applies a force to the body support structure, including to the body support members 26. The force causes the body support members 26 to deform, for example by bending as the ends 30, 130 thereof slide relative to the frame 16, and side sections 18, with the body support members 26 flexing between a nominal configuration (FIG. 11A) to a flexed configuration (FIG. 11B) while also compressing the spring 218. As the SMA is activated, or energized, the SMA is heated to its transition/transformation temperature, wherein the SMA contracts from a non-energized (and elongated) state to an energized (and shortened) state (FIG. 11C). As the SMA 200 contracts or shortens, the SMA biases, e.g., pulls or forces, the body support member 26 forwardly (backrest) or upwardly (seat) from the flexed configuration to the nominal configuration (FIG. 11C), with the spring 218 still in a compressed state. The combination of the SMA 200 and conduit 212 are much more flexible than the body support member 26, such that the SMA and conduit do not provide excessive resistive force to the user and deflection of the body support members 26 before being energized.

Figure 12:
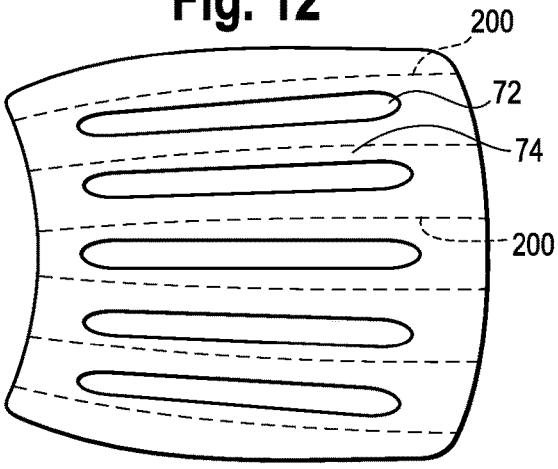
FIG. 12 is a front perspective view of another embodiment of a body support member.

As shown in FIG. 12, the SMA may be secured to the straps 74 extending laterally across the shell 70, for example along the rear side of the shell. Alternatively, the SMA may be in-molded with the shell. In one embodiment, the SMA(s) 200 may be grounded at opposite ends thereof, with the shell floating on the SMA. In embodiment, the shell may be entirely supported by the SMA. The SMA may be activated or energized to change the curvature of the shell in the lateral direction.

Figure 13:
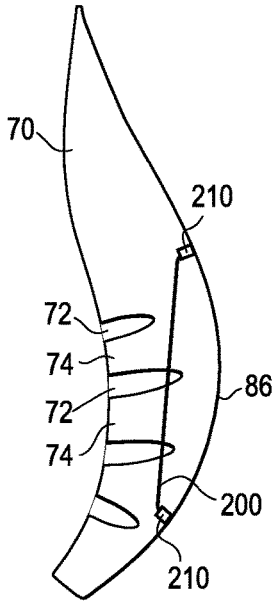
FIG. 13 is a side view of an embodiment of body support member, shown for example in FIGS. 6 and 7, with a shape memory material couple thereto.
Figure 14A:
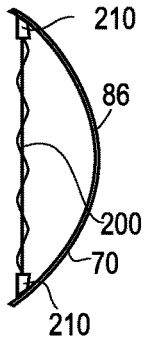
FIGS. 14 A, B and C are side views of the body support assembly shown in FIG. 13, with the support element in a nominal, non-energized state, a flexed, non-energized state, and a nominal, energized state respectively.
Figure 14B:
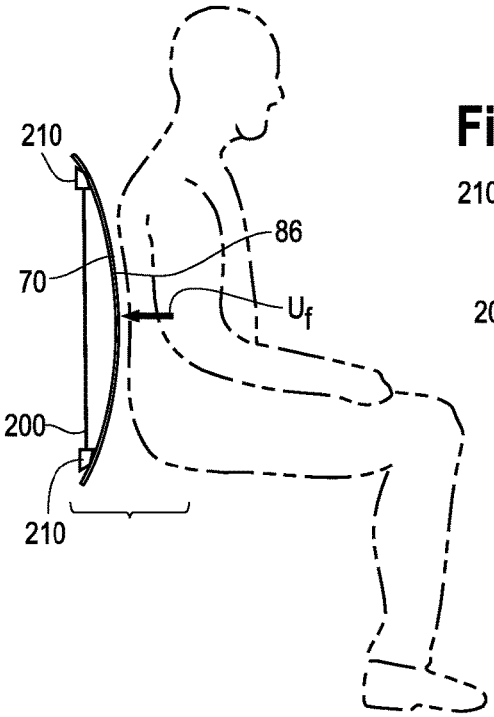
Figure 14C:
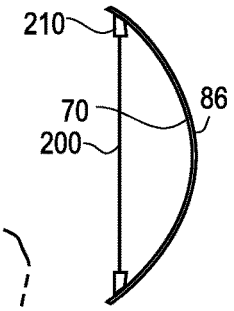

Referring to FIGS. 13-15 and 34, the SMA 200 may also be used to alter or change the curvature in the longitudinal direction. As shown in the embodiment of FIG. 13, the SMA has opposite ends 210 fixedly coupled to the body support member, e.g. shell 70, at longitudinally spaced apart locations, or coupled to spaced apart portions of the bowed screen 710. In one embodiment, an SMA may be coupled to each side section 76 of the body support member, although a single SMA may be positioned along a centerline of the body support member, or more than two SMAs may be employed. Referring to FIG. 14A, a backrest body support member 70 is shown in an unloaded, or nominal configuration, with the SMA 200 in a non-energized state. The SMA may have some slack in this configuration. The body support member has a curvature, defined by a forwardly facing bowed portion 86. Referring to FIG. 14B, a user $U_F$ applies a force to the body support structure, including to the body support member 70, causing the body support member to flex or deflect rearwardly, flattening the curvature of the bowed portion 86, with the SMA becoming taught but still in the non-energized state. The SMA 200 is then activated, or energized to the transition/transformation temperature, such that the SMA is contracted or shortened, thereby applying a force to the back support member 70 and thereby biasing the back support member toward a nominal configuration (FIG. 14C). It should be understood that biasing the support member 70 toward the nominal configuration may not return it all of the way to the unloaded nominal configuration (FIG. 14A), since a load is still being applied by the user $U_F$. Likewise, the SMA may be activated to alter the curvature of the screen 700, which may change the overall opacity of the screen. The controller 208, and/or user, may cycle the SMA between the different states so as to provide different amounts of stiffness.

Figure 15:
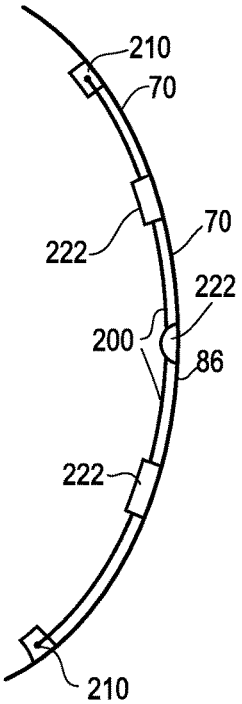
FIG. 15 is a side view of another embodiment of a body support assembly.

Referring to FIG. 15, one or more intermediate guides 222 may be coupled to the body support member, with the SMA 200 (including a coating or sheath) threaded loosely through the guides 222. As with the embodiment of FIG. 13, activation of the SMA 200 shortens the SMA and increased the curvature of the back support member 70.

Other Office Systems

Referring to FIG. 16, radiant heat $H_R$, for example from a user, may activate or energize an SMA 299, which opens the vents 92, 94, thereby allowing for the flow of air and the accompanying cooling effect. One or more SMAs may be attached to the top of the vent 94, and lift the vent as the SMA(s) is activated. The SMA(s) may alternatively be attached to a bottom of the vent 92, or SMA(s) may be coupled to a combination of vents 92, 94 that move in opposite directions.

Figure 18:
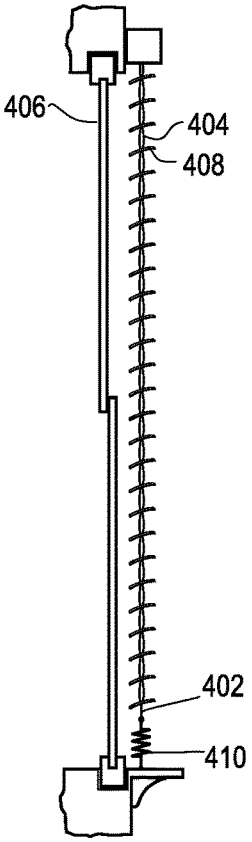
FIG. 18 is side view showing a window shade with a shape memory material actuator.

Likewise, referring to FIG. 18, an SMA 402 may be coupled to a blind 404 or window 406, having a moveable shade system 408. The SMA is activated in response to radiant heat directed at the window, with the SMA activated to close the shade, and a return mechanism 410 (e.g., spring) operable to open the shade when an ambient temperature is realized. The system may be tuned such that the activation temperature may be set by the user.

Referring to FIGS. 19, 25, 26A-B, 31 and 38A-C, SMAs 420 may also be used to create a non-mechanical lock responsive to current, rather than using a motor. In one embodiment, the system may require authentication from a source, allowing the smart furniture, or access device, such as a drawer, cabinet, or door, to identify the user, for example through a badge (RFID), PIN, APP via Bluetooth, etc., Biometric or actuation. The SMA engages to allow the appropriate device, e.g., drawer, to open. The system may be configured to allow only a single drawer to open at a time, with a direct lock on each drawer ensuring other drawers may be kept closed for security and safety. Also, a facilities manager would no longer need master keys but could easily program who has access to what access device.

Figure 26A:
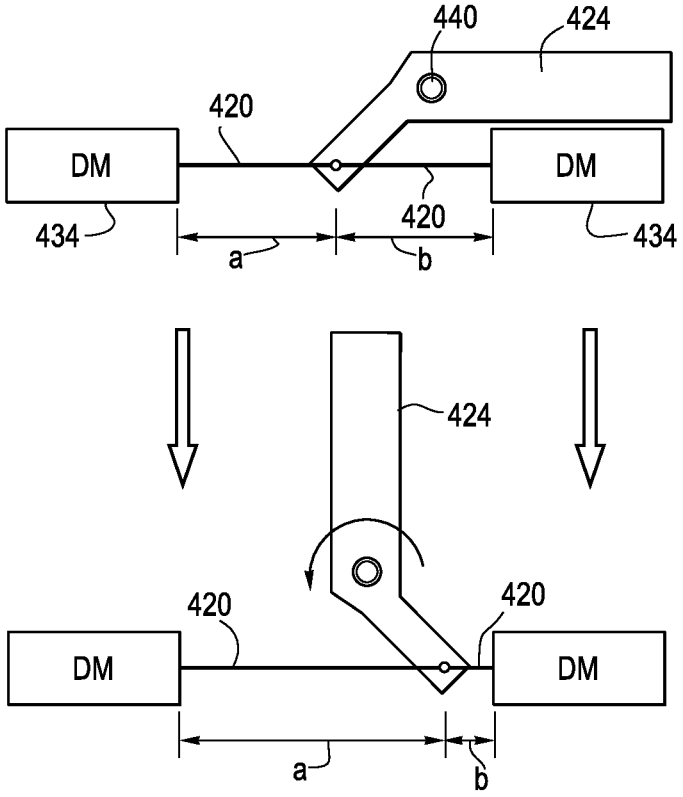
FIG. 26A is a schematic of another lock mechanism embodiment incorporating a shape memory material actuator and distance multiplier.

The office system may include a lock bolt (understood to include a latch member that is temporarily engaged) 426, 424, which may move linearly (e.g. translate) (FIGS. 25 and 38A) or rotatably (e.g., rotate or pivot) (FIGS. 26A and B and 28B and C). An SMA actuator is coupled to the lock bolt (or latch component or other engaging component engaging the bolt), or acts thereon, so as to move the bolt/latch into or out of engagement with an engagement component 428, such as a strike plate or bolt 424, used for example on a door or drawer.

A distance and/or force multiplier 434 may be disposed between the SMM actuator and the bolt, or incorporate the SMA, such that the amount of extension or contraction of the SMA actuator may be multiplied to act on the total stroke of the lock bolt or latch, or such that the force applied by the SMA may be multiplied. A such, the phrase "distance multiplier" refers to a system or device that moves one component relative to another a second distance that is greater than a first distance moved by an actuator, for example the SMA actuator, while the phrase "force multiplier" refers to a system that reduces the amount of force applied by the actuator/applicator, for example the SMA actuator, necessary to move an object. Force multipliers are useful for lifting heavy objects or doing other things that require large amounts of force. For example and without limitation, the SMA may be contractible a first distance between at least a non-energized state and an energized state in response to an application of energy, and the distance multiplier moves the second component relative to the first component a second distance when the shape memory material is contracted to the energized state, wherein the second distance is greater than the first distance. Conversely, in other embodiments, the SMA may apply a force through contraction that is multiplied to apply a greater force to a component coupled thereto. For example, a pulley system may incorporate a SMA to function as a force multiplier.

Figure 19:
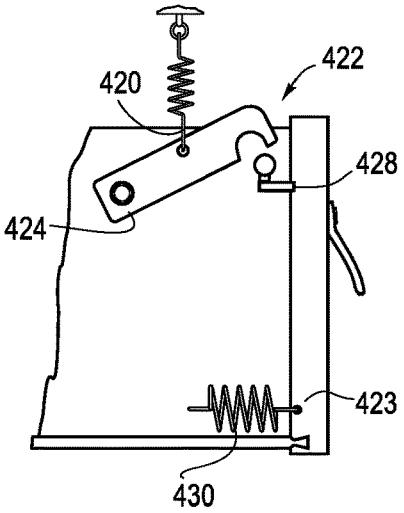
FIG. 19 shows schematic of various locking devices using a shape memory material.

In one embodiment shown in FIG. 19, when the latch 428 is released, the component, e.g., drawer 432, is automatically opened, for example by the force of a spring 430. Referring to FIG. 26A, the lock bolt 424 is acted on by a pair of SMA actuators 420, each coupled to, or incorporated into, a distance multiplier 434. In one sequence, a first SMA actuator rotates the lock bolt about a rotation axis 440 in a first direction from an unlocked position to a locked position. In a second sequence, a second SMA actuator rotates the lock bolt about the axis 440 in a second direction opposite the first direction from the locked position to the unlocked position. The SMA actuators may also maintain a greater or lesser force on the lock bolt to maintain the position thereof.

Figure 26B:
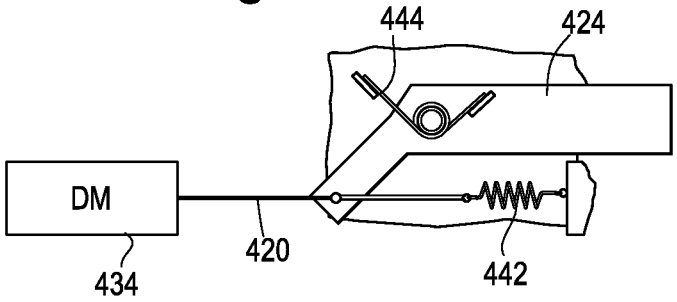
FIG. 26B is a schematic of the lock mechanism embodiment of FIG. 26A incorporating an alternative shape memory material actuator and distance multiplier.

Referring to FIG. 26B, one of the SMA actuators 420 may be replaced with a spring, for example an extension spring 442 (compression or tension) or torsion spring 444, or combinations thereof. The spring acts on the lock bolt to rotate it in a first or second direction to move the lock bolt to one or the other of the locked or unlocked positions.

Figure 31:
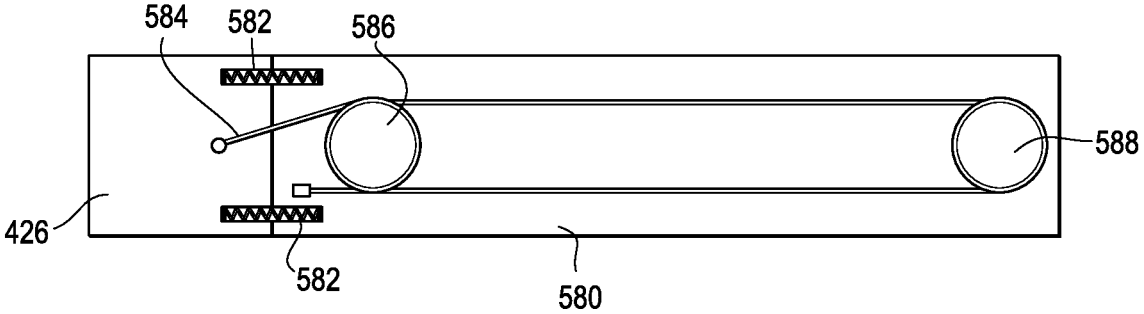
FIG. 31 is a schematic a lock mechanism incorporating a shape memory material and distance multiplier.

Referring to FIG. 31, one or more springs 582 (e.g., compression/tension/torsion) bias a lock bolt 426 away from a base component 580 when an SMA 584, having one end coupled to the bolt and another coupled to the base, is not activated. Activating the SMA 584 moves the bolt 426 toward the base 580, thereby opening the lock. A distance multiplier, shown as a first fixed pulley 586 and second moveable pulley 588, assist the SMA in moving the bolt.

Figure 38A:
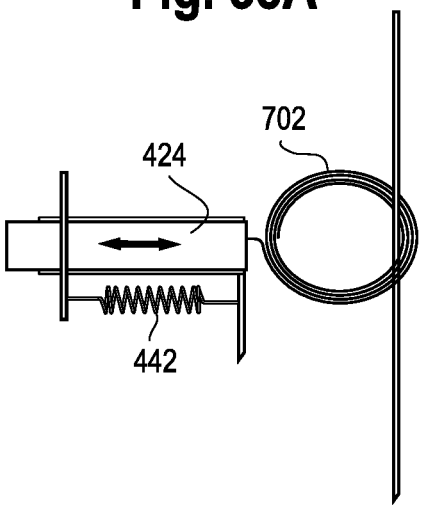
FIGS. 38A-C are three different lock/latch embodiments incorporating an SMA.
Figure 38B:
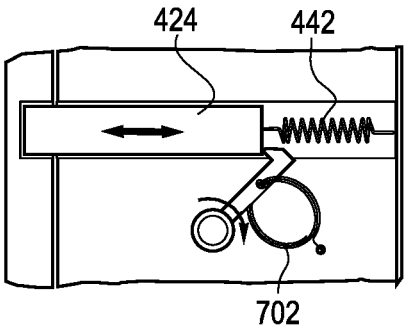
Figure 38C:
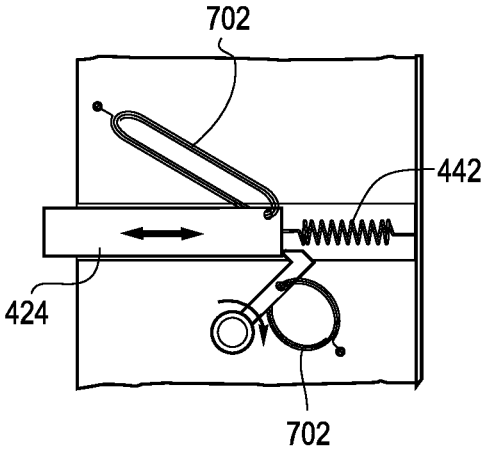

Referring to FIG. 38A, the SMA 702 (e.g., coil in an unactivated state) may be activated and act directly on the bolt 424, or latch, and move the bolt, for example by translation relative to a strike to disengage the bolt from the engaging member, overcoming the force of the spring 442. A return spring 442 may act on the bolt or latch to reengage the bolt or latch with the engaging member after the SMA is deactivated. Referring to FIG. 38B, an SMA distance and/or force multiplier (e.g. coil 702), rotates the latch when activated, thereby disengaging from the bolt 424 and allowing the spring 442 to disengage the bolt from the strike. In this way, the SMA acts as a trigger. Referring to FIG. 38C, a first SMA acts as a trigger to release the bolt, with another SMA acting in an opposite direction to reengage the bolt. In this embodiment, the spring 442 may function to help retract the bolt from the strike once the bolt is disengaged.

Figure 32:
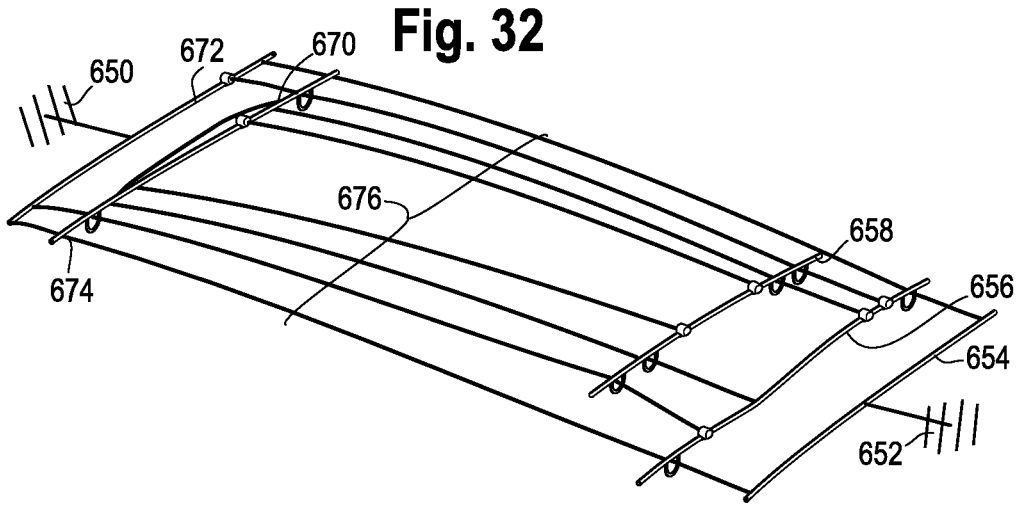
FIG. 32 is a schematic of an alternative distance multiplier.

Another distance and/or force multiplier 590, which may be used with the various SMA actuators disclosed herein, is shown in FIG. 32. The distance multiplier is fixed at both ends 650, 652. A plurality of cross bars (654, 656, 658, 670, 672) are spaced apart between the ends, with some of the cross bars configured with guides 674. SMA strands 676 are coupled between different combinations of cross bars, with some of the strands passing though guides 674 on the crossbars. The various strands may be activated, with the distance and/or force multiplier 590 function as a block and tackle system.

Figure 33:
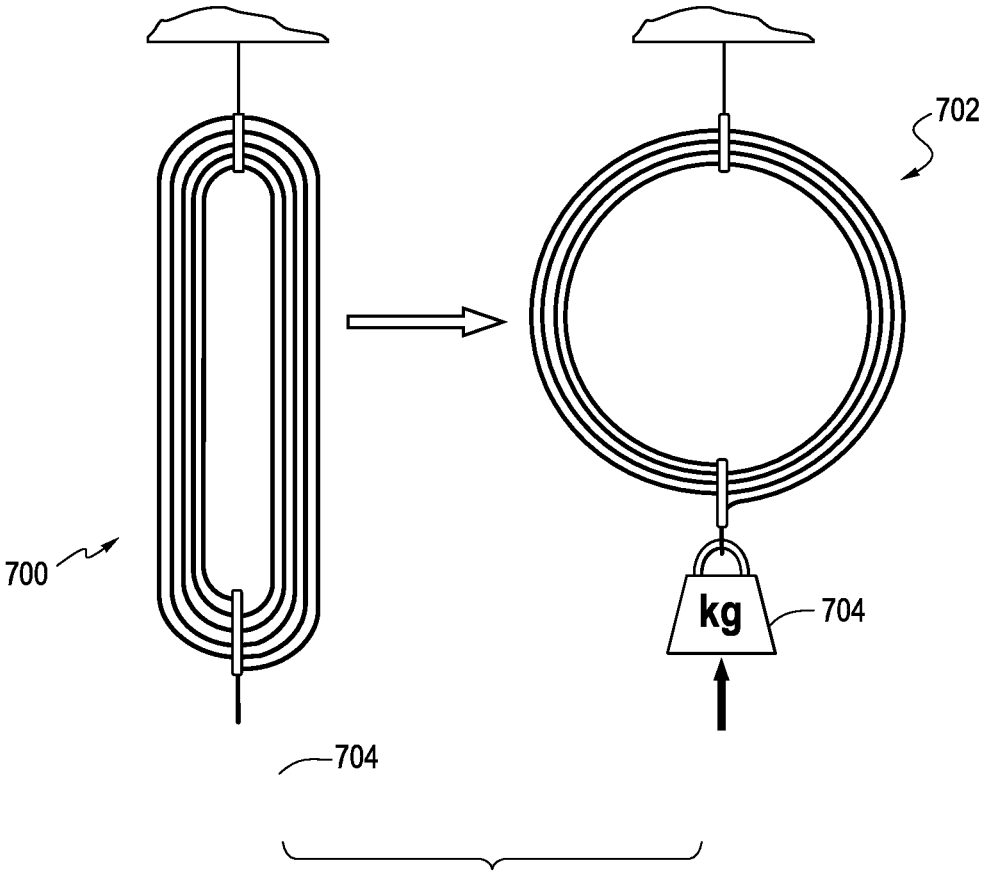
FIG. 33 is a schematic of an alternative distance multiplier.

Referring to FIG. 33, another distance and/or force multiplier 700 is shown as including a coiled SMA 702, as referred to above. A component 704 to be moved, or actuated, is secured to one side of the coiled SMA 702. When activated, the coiled SMA 702 stiffens or assumes a more circular shape, thereby moving or actuating the component 704, enabling a force to be applied to the component 704 as the coil displaces (e.g., the overall height/width/length across the portion applied between the components is lessened upon actuation), thereby moving the component.

It should be understood that the various distance and/or force multipliers disclosed herein, and incorporating an SMA, may be used in other types of office systems, including furniture such as cabinets, worksurfaces, etc., to interface between first and second components, whether to effect a change in position between such components (rotational, translational or a combination thereof), or to apply a force between such components, or to one of the components.

Figure 37:
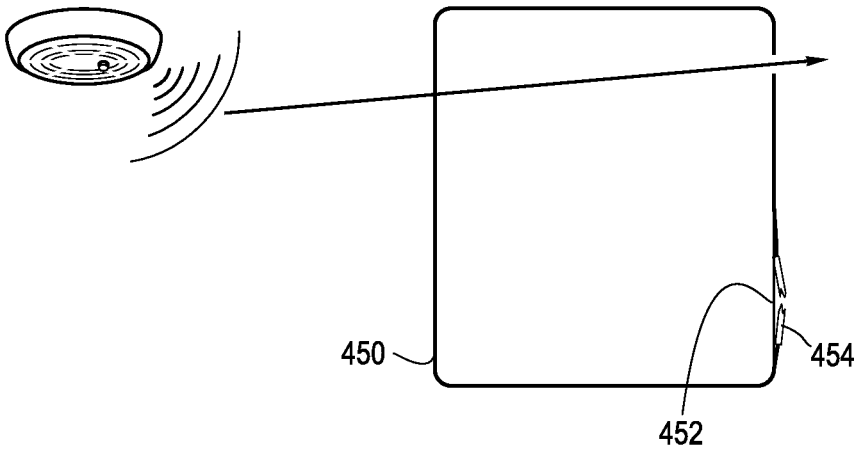
FIG. 37 is a schematic of a room having an SMA triggered seal release.

Referring to FIG. 37, in addition, the SMA 452 may be used in an office system to break the seal of a door or room 450 (e.g., a V.I.A. (virtual intelligent architecture) space available from Steelcase, Inc.), for example by opening a vent, 454 such that sounds, including fire alarms and other emergency public address notices, may be heard in the room, which may be sound proofed.

Figure 20:
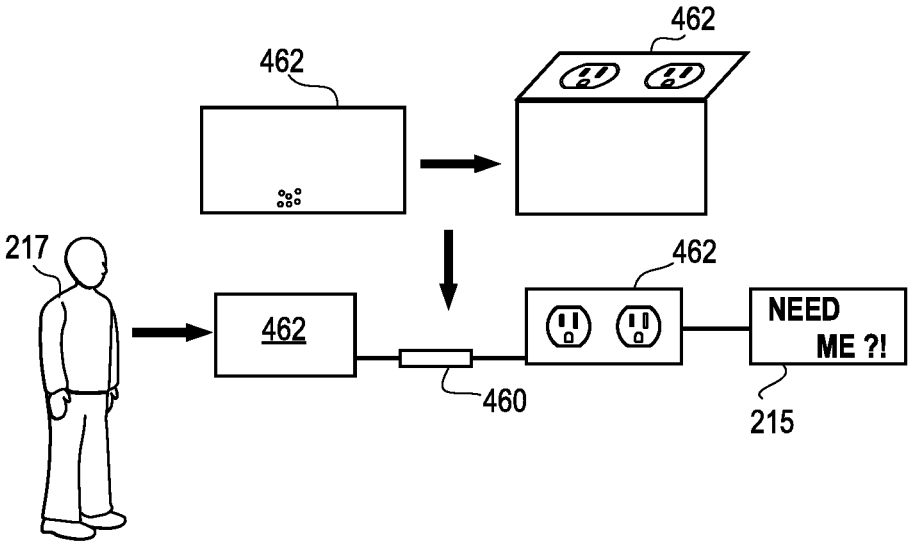
FIG. 20 is a schematic showing an office environment with shape memory materials actuating various accessories and/or user interfaces.

Referring to FIG. 20, a SMA 460 may be used as a prompt in an office environment or system m help "humanize" the furniture or components. For example, the SMA 460 may be activated to offer the user a particular accessory, such as an outlet or user interface, e.g., buttons, by opening a door or flip top after the user is recognized by the system, for example by PIR, capacitive, etc.). A sensor 462, including in one embodiment the SMA, may recognize or sense for example body heat or contact (e.g., when the user sits in a chair), with the input activating the SMA 460. A prompt may be sent to the user through a remote device 215.

Figure 21:
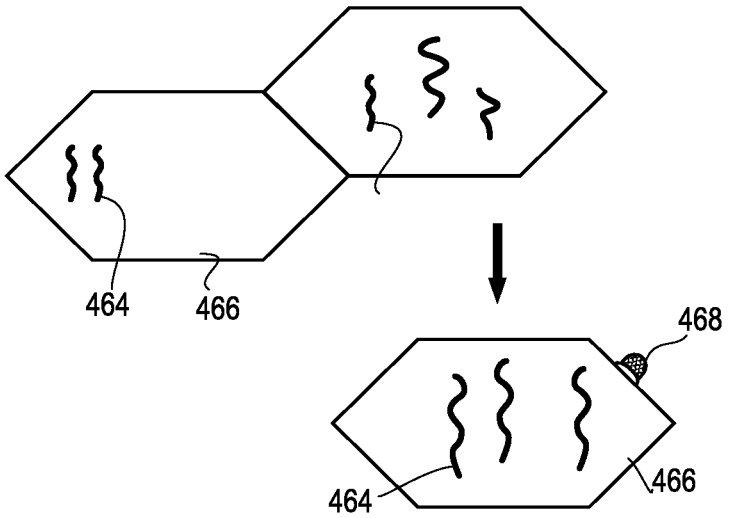
FIG. 21 is a schematic diagram of a sound absorption material or art display using a shape memory material.

Referring to FIG. 21, one or more SMAs 464 may be used to change the shape of artwork or sound absorption material 466 in an office system. For example, using a microphone 468, the room may sense or register a laud ambient signal, with the SMAs 464 then being activated to make the art or material 466 thicker, e.g., having a greater depth (3 inches v. 1 inch), which provides for better sound absorption, for example during a loud meeting. Because the change occurs organically, the room is not made to feel smaller. In other wards, the room reacts to the noise level and responds to absorb more of the noise.

Figure 22A:
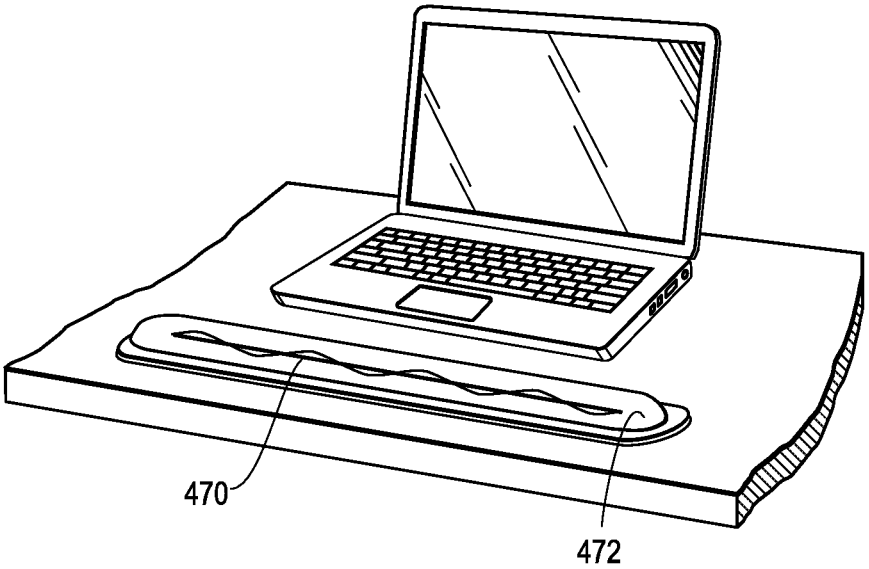
FIGS. 22A and B are perspective view of various office components using a shape memory material.
Figure 22B:
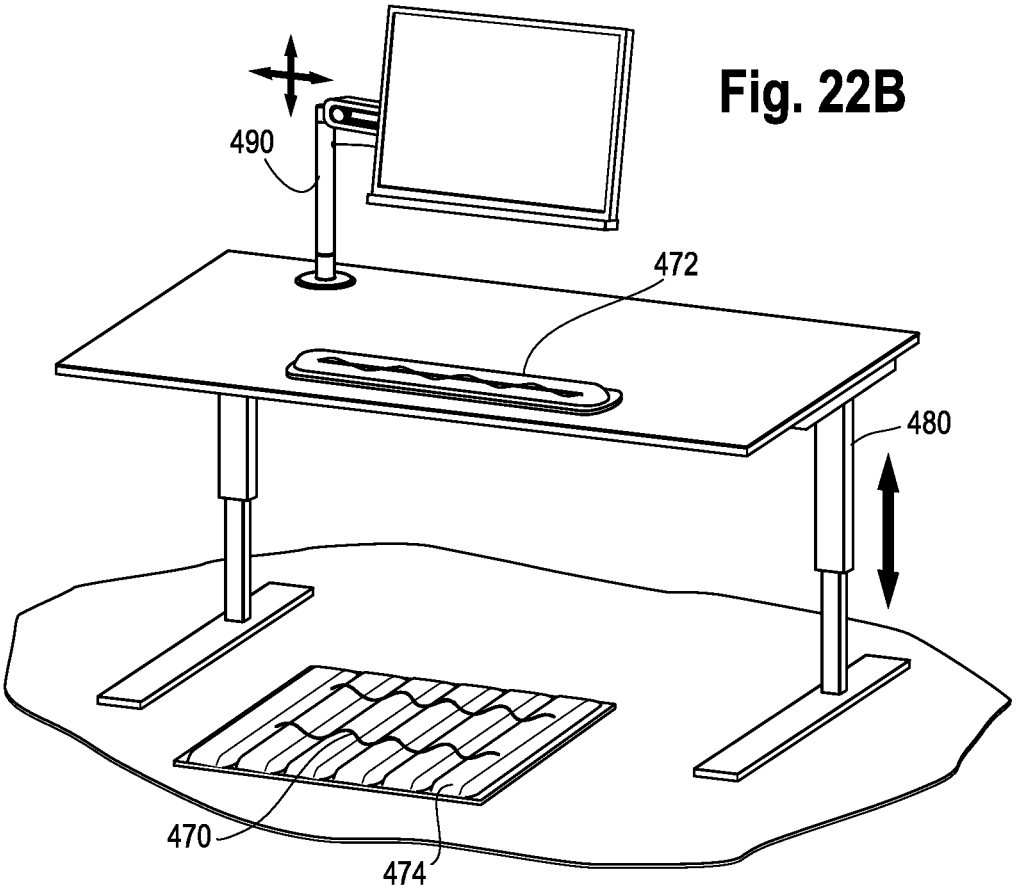
Figure 23:
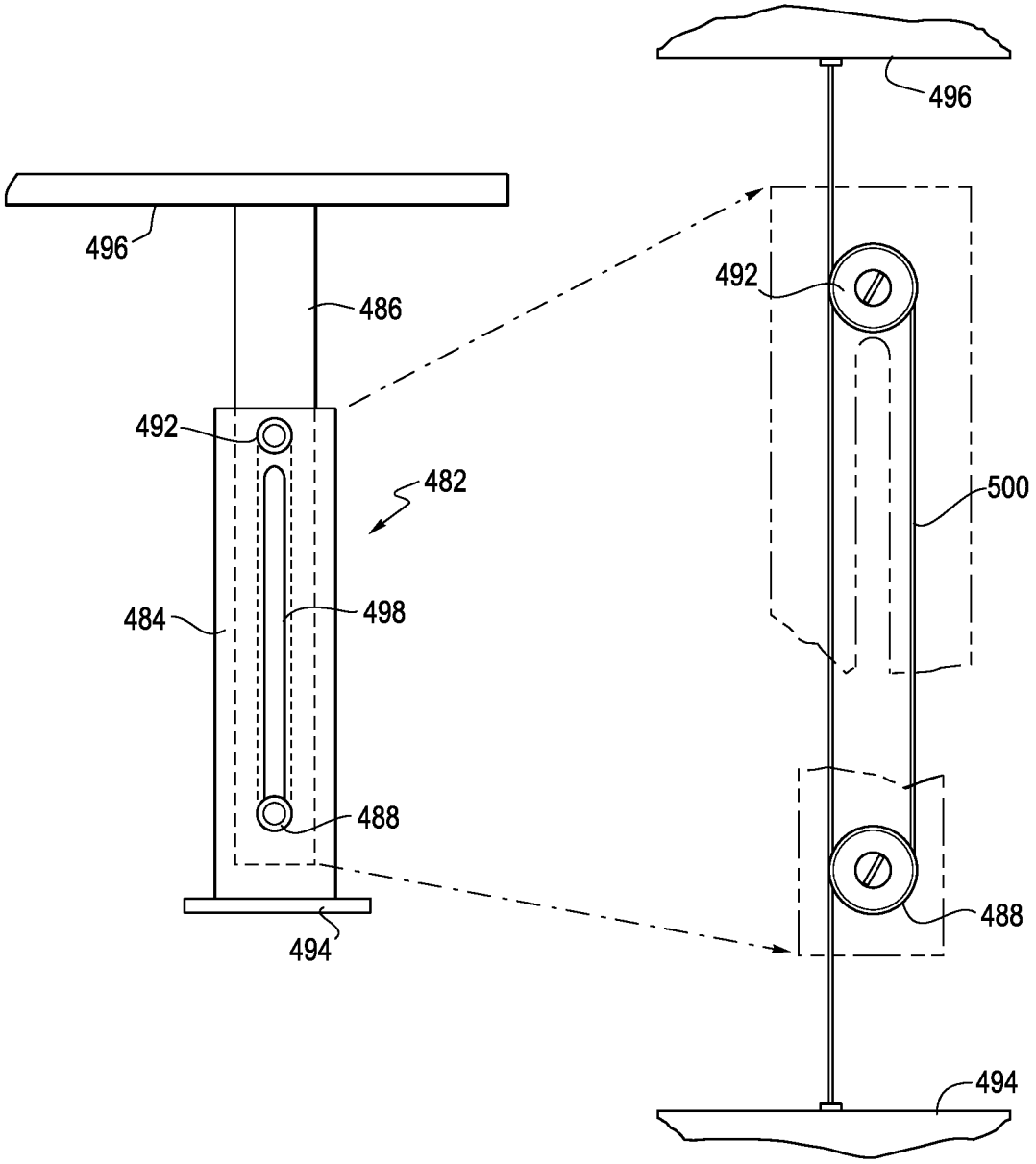
FIG. 23 is a cross-sectional view of a height-adjustable desk incorporating a shape memory material.

Referring to FIGS. 22A and B, an SMA 470 may create a 'breathing prompt' as part of a larger or varied office system. For example, an SMA may be incorporated into a wrist pad 472, for example in front of a key board, with the pad providing micro adjustment to help prevent carpal tunnel and repetitive strain injuries. Also, SMAs 470 may be incorporated into a gel-like pad 474 that encourages shifting of weight while standing, a height adjustable desk 480, which encourages movement of the desk up and down to help vary postures, or an SMA-enabled monitor support 490 which moves to prevent neck strain.

Figure 36A:
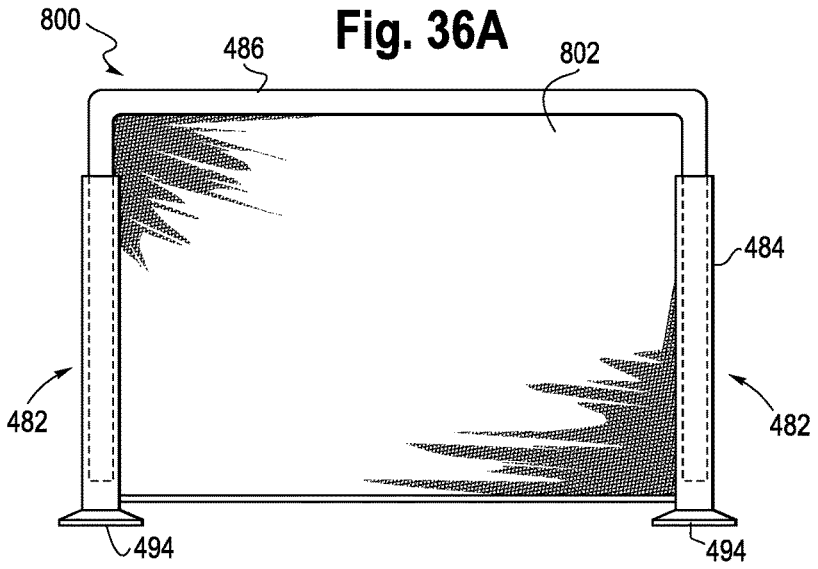
FIG. 36A is a front view of a privacy screen incorporating a shape memory material in a first, lower position.
Figure 36B:
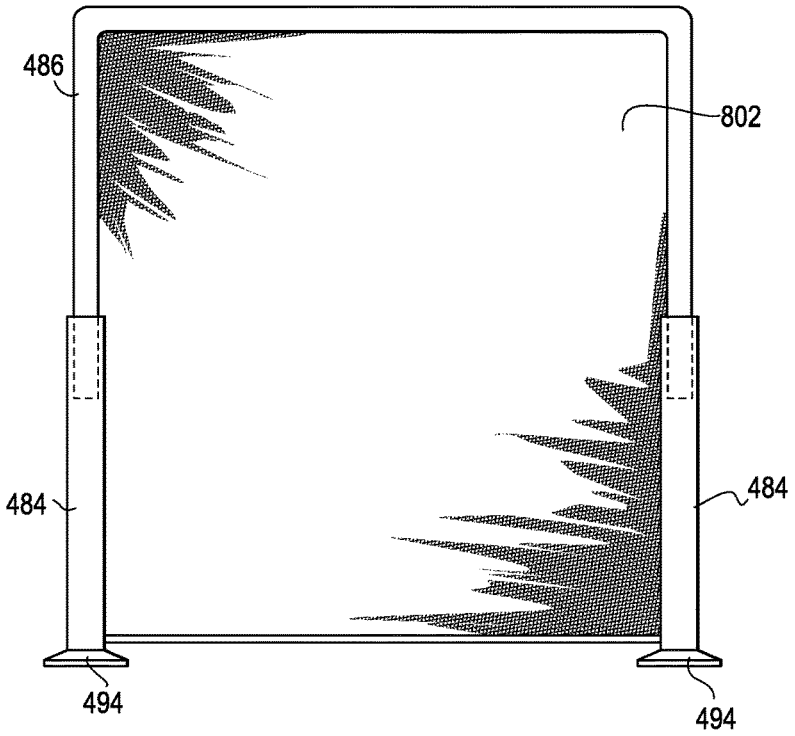
FIG. 36B is a front view of the screen shown in FIG. 36A in a second, upper position.
Figure 36C:
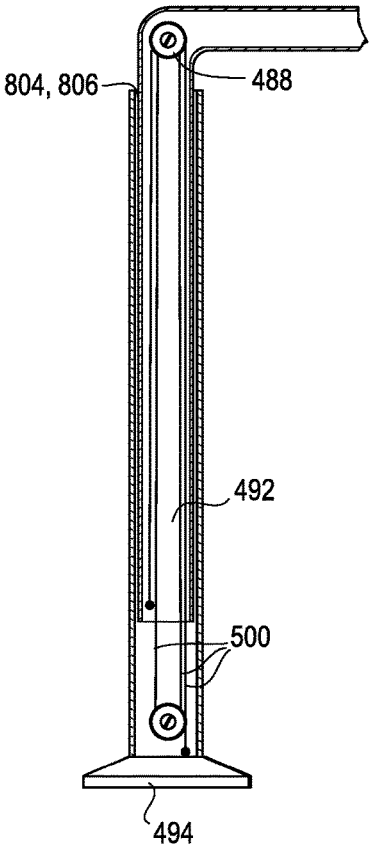
FIG. 36C is a partial cross-sectional view of a screen support shown in FIG. 36B.

For example, referring to FIGS. 23 and 36A-C, the office system may be configured as a height adjustable desk 480 and height adjustable privacy screen 800 both include one or more telescopic legs 482, each having an upper portion 486 coupled to a desk top 496 (or upper portion of a screen 802) and a lower portion 484 coupled to a foot or base 494. The upper portion 486 (and worksurface or screen) moves vertically relative to the lower portion 484. A first pulley 492 is attached to the lower portion 484, and a second pulley 488 is attached to the upper portion 486. In one embodiment, a slot 498 is formed in the upper portion, with an axle of the first pulley 492 traveling in the slot during operation. A cable, or other non-extensible, flexible member 500, is secured to the foot 494 and desk top 496 (or upper portion 486 as shown in FIG. 36C), and makes one or more loops around the pulleys 492, 488. A portion or entirety of the cable 500 is formed from or configured with a SMA, which may be activated to raise and/or lower the desk top through the pulley system, otherwise referred to as a distance multiplier. The SMA actuator and distance and/or force multiplier may be activated by an acoustical noise, for example detected by a sensor 804 and controller 806, or by a manual switch or other controller. The screen 802, which may be made of a stretchable or foldable material, may be extended or contracted as the legs 482 are extended or contracted respectively.

Figure 29A:
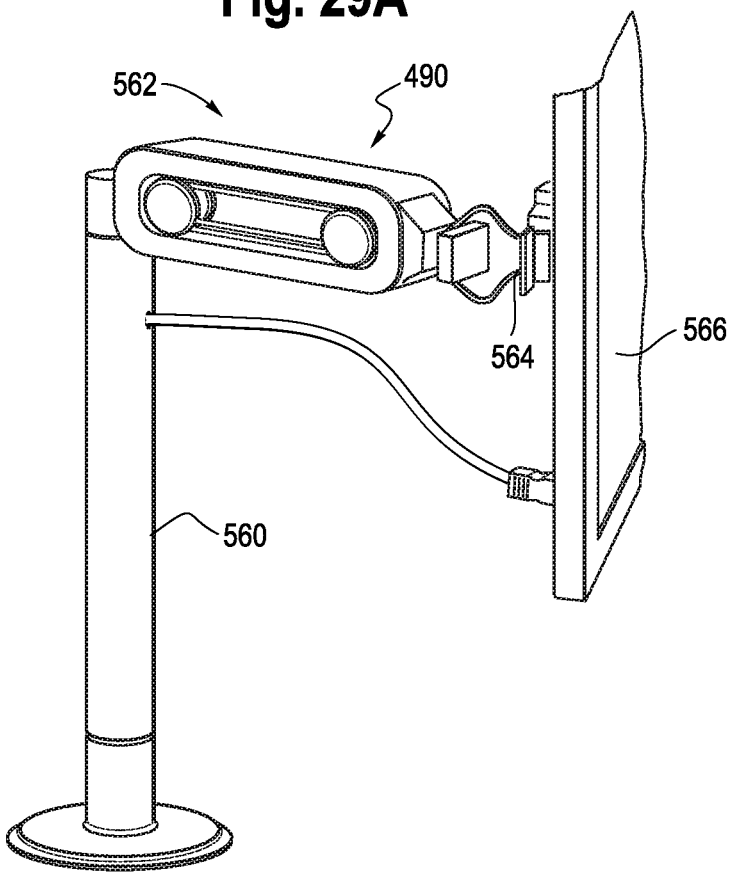
FIG. 29A is a perspective view of a monitor support arm incorporating a shape memory material actuator.
Figure 29B:
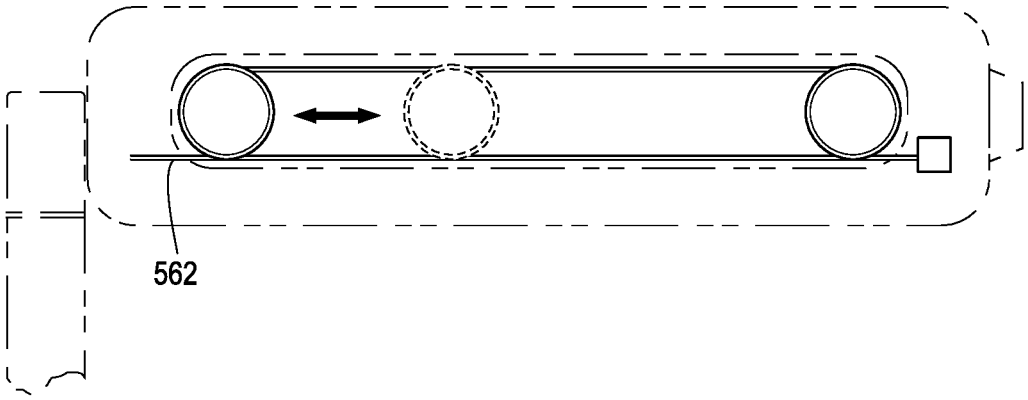
FIG. 29B is a schematic of the shape memory material actuator used in the monitor support arm of FIG. 29A.

Referring to FIGS. 29A, B and 30, the monitor support 490 includes an upright portion 560, an arm portion 562 and a mounting portion 564 supporting a display 566. As shown in FIG. 29B, the arm portion may include a pair of pulleys, including a first pulley 568 that is fixed (non-moveable) and as second pulley 570 one being moveable/slideable relative to the first pulley. A SMA is wrapped round the pulleys 568, 570, which function as a distance and/or force multiplier, with one end being fixed and the other end being attached to a portion of the arm portion that causes the monitor arm to raise/lower/pivot/tilt to ensure the proper position of the display 566. The arm portion, and other components, may be configured as four-bar mechanisms, each associated with a degree of freedom. Each four-bar mechanism may be configured with a pair of opposing distance multipliers and SMA combinations.

Figure 30:
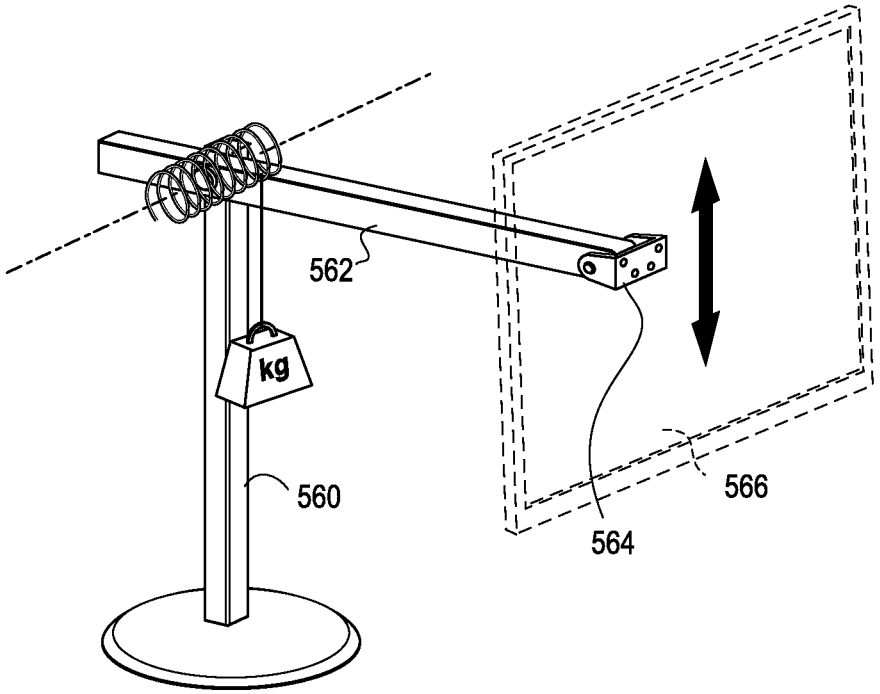
FIG. 30 is a perspective schematic view of an alternative monitor support arm.

In an alternative embodiment, shown in FIG. 30, the monitor support is configured with a trebuchet mechanism, which rotates the arm 562 and display 566 and includes a counterweight. SMA coils, which may be activated, cause the arm to rotate.

Figure 28:
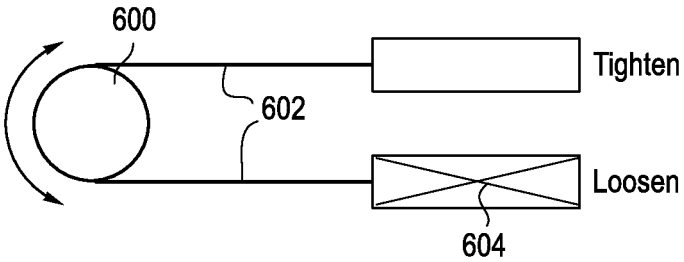
FIG. 28 is a schematic of an air touch adjustment member incorporating a shape memory material.

Referring to FIG. 28, an actuator system uses an adjustment bolt 600 to adjust the tension of the system, for example for a worksurface lift system. The bolt may be rotated in either rotational direction. A SMA 602 may be incorporated and coupled to the bolt to rotate the bolt 600 in one or both directions and thereafter lock/hold the bolt in the desired position. A return spring 604 may be coupled to one end of the SMA to rotate the bolt in one direction.

Figure 35A:
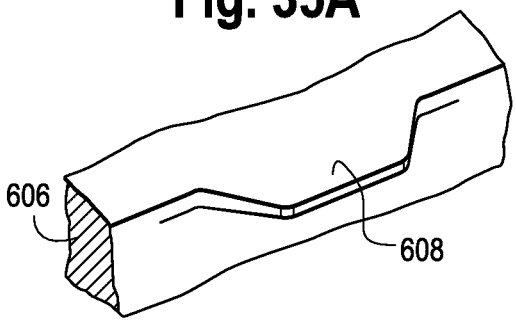
FIG. 35A is a partial, perspective view of a table having an adjustment interface.
Figure 35B:
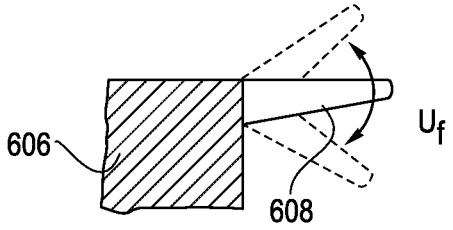
FIG. 35B is a side view of the table and interface shown in FIG. 35A.
Figure 35C:
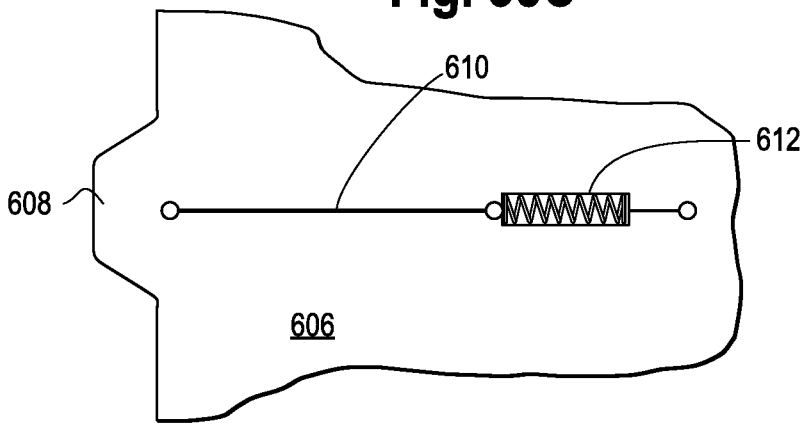
FIG. 35C is a bottom view of the table and interface shown in FIG. 35A.

Referring to FIGS. 35A-C, a lever/tab 608, or actuator, is coupled to a worksurface 606. The lever 608 may be moved, e.g., translated or rotated, in opposite first and second directions by a user $U_F$, for example to release a lock or latch such that the worksurface may be moved, whether by translation (e.g., vertical movement) or rotation (e.g., flip top table). The lever is coupled to the latch/lock/clutch, or other mechanism, by a SMA wire 606 and spring 608. In a nominal position (FIG. 35A), the SMA 606 and spring 608 are balanced. As the lever 608 is moved upwardly, the SMA 606 and spring 608 are stretched such that an increased tensile stress is measured and the worksurface is raised. As the lever 608 is moved downwardly, the nominal tension is released and the worksurface may be lowered. The variable stress in the SMA provides for speed control of the worksurface movement.

Figure 24A:
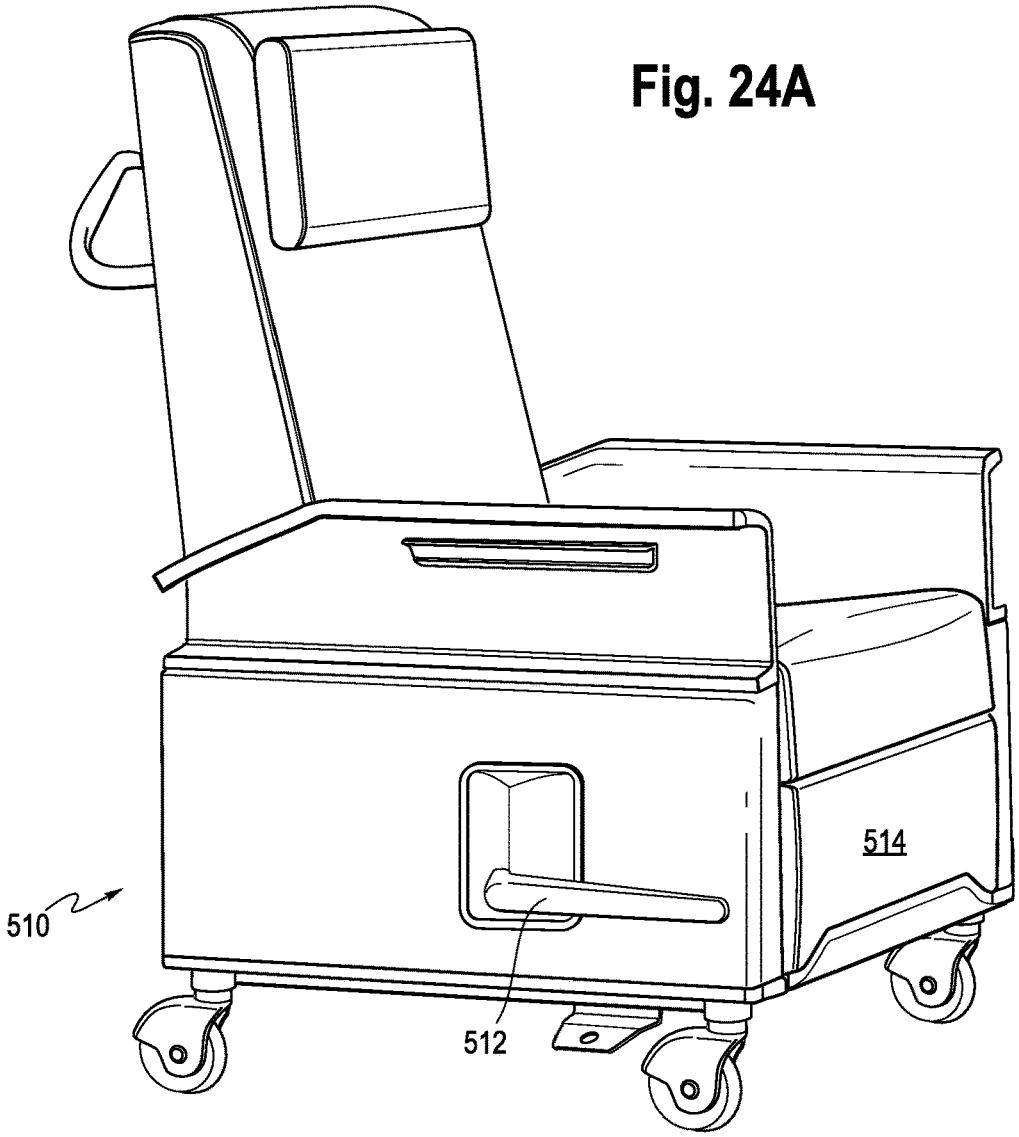
FIG. 24A is a side perspective view of one embodiment of a seating structure having an actuator lever.
Figure 24B:
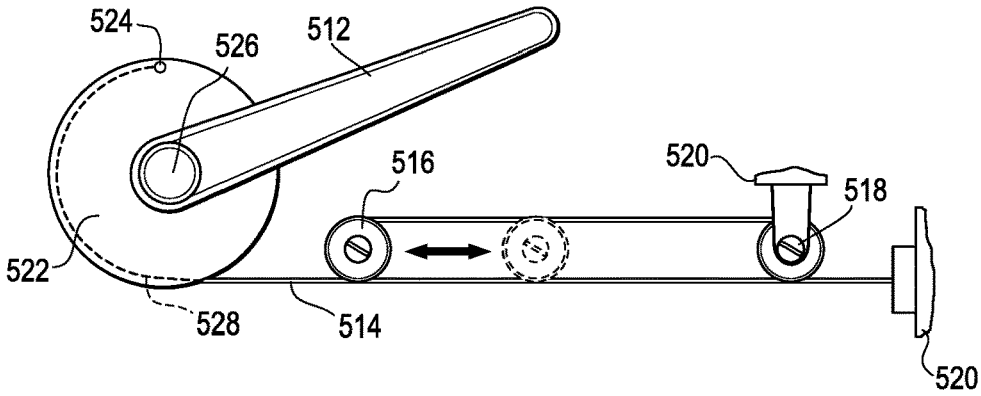
FIG. 24B is a side view of an actuator lever incorporating a shape memory material.
Figure 25:
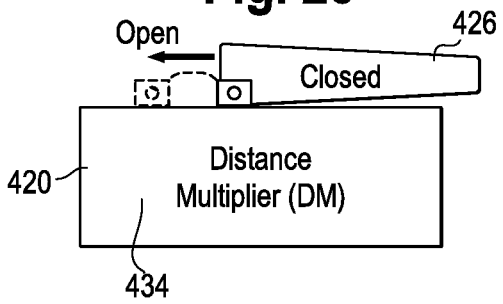
FIG. 25 is a schematic of a lock mechanism incorporating a shape memory material and distance multiplier.

Referring to FIGS. 24A and B, a recliner chair 510 is shown with a lever 512 that is rotated/pivoted to actuate a footrest 514. The lever 512, and a cam 522 coupled thereto, is rotatable about a fixed axis 526. A cable 528 is coupled to the cam 522, for example at a peripheral location 524, and wraps around a circumferential surface of the cam 522. An opposite end of the cable 528 is secured to a fixed (non-moveable) portion of the chair, for example a frame 520. A first pulley 518 is also fixedly located, for example by attachment to the frame 520, while a second pulley 516 moves or slides relative to the first pulley 518. The cable 528 wraps around the pulleys. A portion of the cable is configured as an SMA. During operation, as the user grasps and rotates the lever 512, the SMA may be activated to assist in rotated the lever 512 by acting on the cam 522.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An office system comprising:

a lower leg portion;

an upper leg portion telescopically and reciprocally moveable relative to the the lower leg portion;

a distance and/or force multiplier disposed between and coupled to the lower and upper leg portions, wherein the distance and/or force multiplier comprises a shape memory material, wherein the shape memory material is contractible between at least a non-energized state and an energized state in response to an application of energy, and wherein the distance and/or force multiplier moves the upper leg portion in a first direction relative to the the lower leg portion when the shape memory material is contracted to the energized state, and wherein the upper leg portion is moveable in a second direction opposite the first direction relative to the lower leg portion when the shape memory material is in the non-energized state.

2. The office system of claim 1 wherein the shape memory material comprises a first shape memory material, and further comprising a second shape memory material, a latch, a base component, and an engaging component, wherein the latch is moveable relative to the engaging component between an engaged and disengaged position as the second shape memory material is contracted to a second energized state.

3. The office system of claim 2 further comprising a spring biasing the latch toward one of the engaged or disengaged positions.

4. The office system of claim 2 wherein the latch comprises a lock bolt.

5. The office system of claim 1 wherein the distance and/or force multiplier comprises a plurality of spaced apart cross bars and a plurality of shape memory strands coupled between different combinations of the plurality of spaced apart cross bars.

6. The office system of claim 1 wherein the distance and/or force multiplier comprises a pulley.

7. The office system of claim 1 wherein the distance and/or force multiplier comprises a coil of the shape memory material.

8. The office system of claim 1 further comprising a worksurface coupled to the upper leg portion.

9. The office system of claim 1 further comprising a screen coupled to the upper leg portion.

10. The office system of claim 1 further comprising a sensor adapted to receive an input and a controller operable to energize the shape memory material in response to the input received by the sensor.

11. The office system of claim 10 wherein the input comprises an acoustical noise.

12. An office system comprising:

a first component;

a monitor support arm moveable relative to the first component;

a distance and/or force multiplier coupled to the monitor support arm, wherein the distance and/or force multiplier comprises a shape memory material, wherein the shape memory material is contractible between at least a non-energized state and an energized state in response to an application of energy, and wherein the distance and/or force multiplier moves the monitor support arm relative to the first component when the shape memory material is contracted to the energized state.

13. The office system of claim 12 wherein the monitor support arm comprises an upright portion and an arm portion moveably coupled to the upright portion, wherein the distance and/or force multiplier is disposed between the upright portion and the arm portion.

14. A seating structure comprising:

a first component;

a second component moveable relative to the first component;

a cam coupled to the second component; and a distance and/or force multiplier disposed between and coupled to the first component and the cam, wherein the distance and/or force multiplier comprises a shape memory material, wherein the shape memory material is contractible between at least a non-energized state and an energized state in response to an application of energy, and wherein the distance and/or force multiplier moves the cam relative to the first component when the shape memory material is contracted to the energized state.

15. The seating structure of claim 14 wherein the first component comprises a frame and a second component comprises a lever.

16. The seating structure of claim 14 wherein the distance and/or force multiplier comprises a pulley.

* * * * *